US005190188A

United States Patent [19]

Credle, Jr.

[11] Patent Number: 5,190,188

[45] Date of Patent: Mar. 2, 1993

[54] CONVERTIBLE BEVERAGE DISPENSER

[75] Inventor: William S. Credle, Jr., Stone Mountain, Ga.

[73] Assignee: The Coca-Cola Company, Atlanta, Ga.

[21] Appl. No.: 709,529

[22] Filed: Jun. 3, 1991

Related U.S. Application Data

[63] Continuation-in-part of Ser. No. 527,229, May 22, 1990, abandoned, which is a continuation-in-part of Ser. No. 129,032, Dec. 4, 1987, abandoned.

[51] Int. Cl.[5] ..... B67B 7/00

[52] U.S. Cl. ..... 222/1; 222/129.1; 222/146.6; 222/183; 312/201; 312/236

[58] Field of Search ..... 222/1, 143, 183, 129.1–129.4, 222/504, 146.6; 312/201, 236

[56] References Cited

U.S. PATENT DOCUMENTS

| | | | |
|---|---|---|---|
| 273,654 | 5/1884 | Sidam et al. . | |
| 3,261,506 | 7/1966 | Chenoweth et al. | 222/129.1 X |
| 3,327,902 | 6/1967 | Alterwitz | 222/129.1 |
| 3,331,536 | 7/1967 | DeLorenzo | 222/129.1 X |
| 3,355,068 | 11/1967 | Harland et al. . | |
| 3,853,244 | 12/1974 | Neumann | 222/129.1 |
| 3,863,810 | 2/1975 | Hanson | 222/129.1 |
| 3,966,091 | 6/1976 | Bencic | 222/129.1 |
| 4,174,872 | 11/1979 | Fessler . | |
| 4,355,735 | 10/1982 | Whorton, III et al. . | |
| 4,496,080 | 1/1985 | Farber et al. | 222/129 |
| 4,520,960 | 6/1985 | Cushman et al. . | |
| 4,577,782 | 3/1986 | Fessler . | |
| 4,582,226 | 4/1986 | Doak . | |
| 4,684,039 | 8/1987 | Wasserstrom et al. | 222/129.1 |
| 4,687,120 | 8/1987 | McMillin . | |
| 4,781,310 | 11/1988 | Credle et al. | 222/129.1 |
| 4,801,048 | 1/1989 | Credle, Jr. et al. . | |

FOREIGN PATENT DOCUMENTS

| | | |
|---|---|---|
| 165792 | 12/1985 | European Pat. Off. . |
| 299767 | 1/1989 | European Pat. Off. . |
| 319348 | 7/1989 | European Pat. Off. . |
| 339387 | 11/1989 | European Pat. Off. . |
| 2308337 | 2/1973 | Fed. Rep. of Germany . |
| 3346240 | 12/1983 | Fed. Rep. of Germany . |
| 2243882 | 3/1988 | Fed. Rep. of Germany . |
| 2230252 | 10/1990 | United Kingdom . |

*Primary Examiner*—Gregory L. Huson

*Attorney, Agent, or Firm*—Thomas R. Boston; W. Dexter Brooks

[57] ABSTRACT

A low cost, multiflavor, compact, versatile, convertible beverage dispenser that can be installed in any one of several different orientations so as to be able to fit in almost any available space. This dispenser can operate frontways or sideways and has a dispense module that is separable from a refrigeration module and that can go on top of a counter while the refrigeration module goes below. This dispenser can be used with either figals or bag-in-box and can be easily modified to dispense different numbers of beverages. When used with bag-in-box the dispenser includes built-in syrup pumps. The dispenser can also be used with a separate, additional narrower dispense module, when the built-in dispense module is too wide for a particular installation.

43 Claims, 18 Drawing Sheets

FIG 1
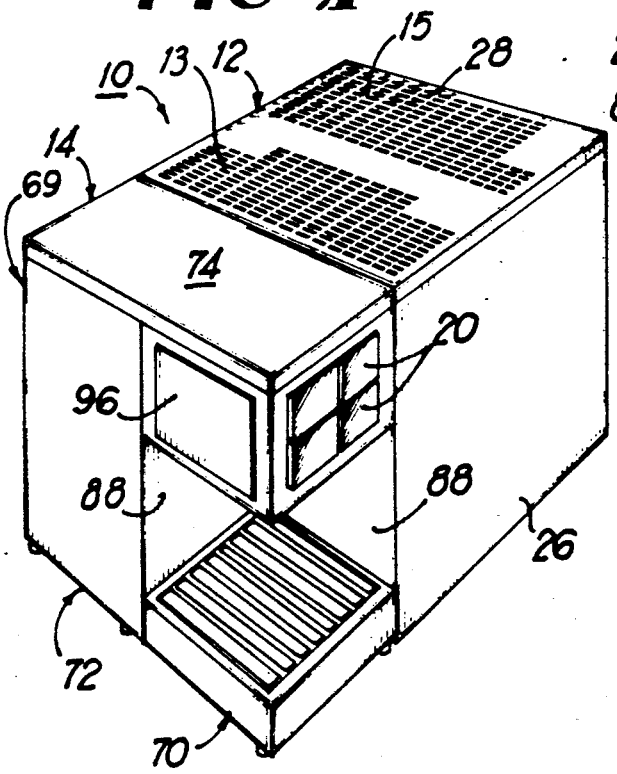
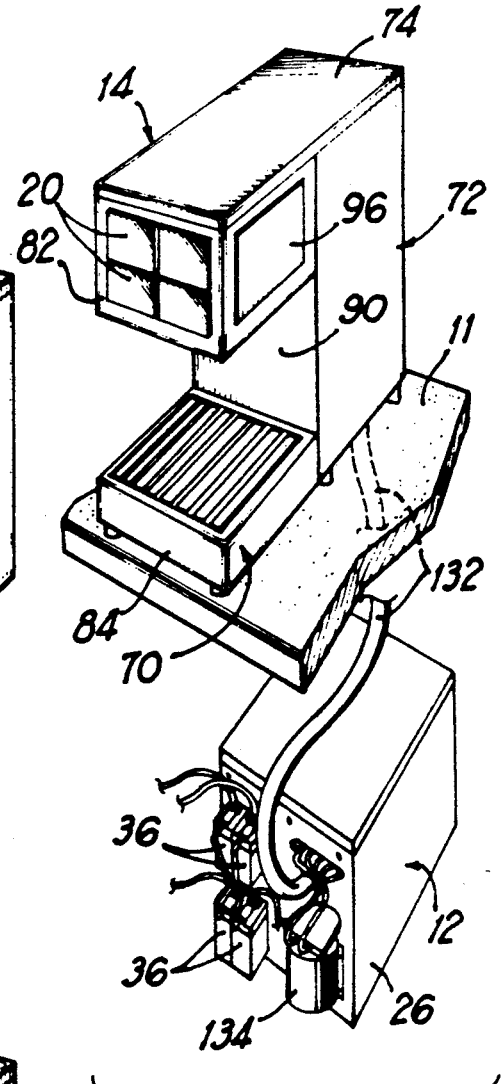
FIG 3
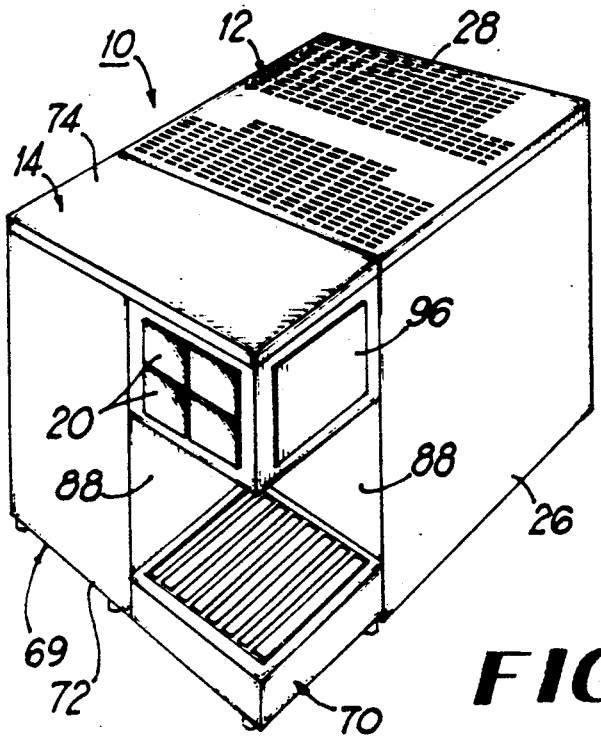
FIG 2

CONVERTIBLE BEVERAGE DISPENSER

CROSS-REFERENCE TO RELATED APPLICATION

This is a continuation-in-part of copending application Ser. No. 07/527,229, filed May 22, 1990, entitled Convertible Beverage Dispenser (now abandoned), which application was a continuation-in-part of application Ser. No. 07/129,032, filed Dec. 4, 1987, and entitled Convertible Beverage Dispenser (now abandoned).

BACKGROUND OF THE INVENTION

This invention relates to counter top, postmix beverage dispensers, and in particular to a low-cost, compact, versatile, multiflavor, convertible beverage dispenser.

A wide variety of different postmix dispensers are known, including those having multiflavor valves and those having the selector buttons and nozzle at a notched corner of the cabinet. It is also known to have a dispensing system in which some parts of the dispenser are located above the counter and some parts are located below the counter.

It is an object of the present invention to provide a unitary beverage dispenser which can be placed entirely on top of a counter and oriented either frontways or sideways or which can be easily separated into a refrigeration module placed below the counter and a small dispense module placed on top of the counter.

It is a further object of this invention to provide a compact, multiflavor, low cost, versatile, convertible postmix beverage dispenser.

It is another object of this invention to provide a beverage dispense that can be easily modified to dispense different numbers of beverages.

It is another object of this invention to provide an improved flow control module and method for easily changing the numbers of beverages to be dispensed.

It is a still further object of this invention to provide a dispenser with two fronts, which can be placed frontways or sideways, and having a small detachable dispense module which can be placed by itself on top of a counter.

It is a another object of this invention to provide a versatile dispenser that can be delivered to an outlet and that will fit in almost any available space.

It is a further object of this invention to provide a single dispenser that is no versatile that it can be used to reduce the need for an inventory of dispensers of different sizes and shapes.

It is another object of the present invention to provide a convertible dispenser having a vent arrangement that has one air-flow when the refrigeration and dispense modules are attached, and a different air flow when the modules are separated, for improved performance.

It is a further object of this invention to provide a compact dispenser having a one-piece wrap-around shell, a removable lid, a vertically oriented condenser and a modular, easily removable condenser fan-motor unit that, when slid out, provides easy access to the agitator motor and the transformer.

It is another object of this invention to provide an improved multiflavor nozzle.

It is another object of this invention to provide a dispenser with an improved water circuit, including one in which the soda or carbonated water is cooled again downstream from the carbonator, and also one in which the soda is continuously recirculated, but not through the carbonator, when the refrigeration module is remote.

It is a further object to provide a dispenser that is small and compact and yet provides a large, smooth, uninterrupted advertising area while also being less expensive to manufacture.

It is a further object to provide a dispenser with a pre-cooling syrup coil whereby the syrup pumps and carbonator can use the same pressure, thus eliminating one of two $CO_2$ pressure regulators.

BRIEF DESCRIPTION OF THE DRAWINGS

The present invention will be more fully understood from the detailed description below when read in connection with the accompanying drawings wherein like reference numerals refer to like elements and wherein:

FIG. 1 is a perspective view of one embodiment of the convertible dispenser of the present invention set up in its "frontways" mode of operation;

FIG. 2 is a view identical to FIG. 1 but with the dispenser set up in its "sideways" mode of operation;

FIG. 3 is a perspective view of the dispenser of FIG. 1 set up with only its narrow dispense module on top of the counter and with the refrigeration module beneath the counter;

SUMMARY OF THE INVENTION

Figure 4:
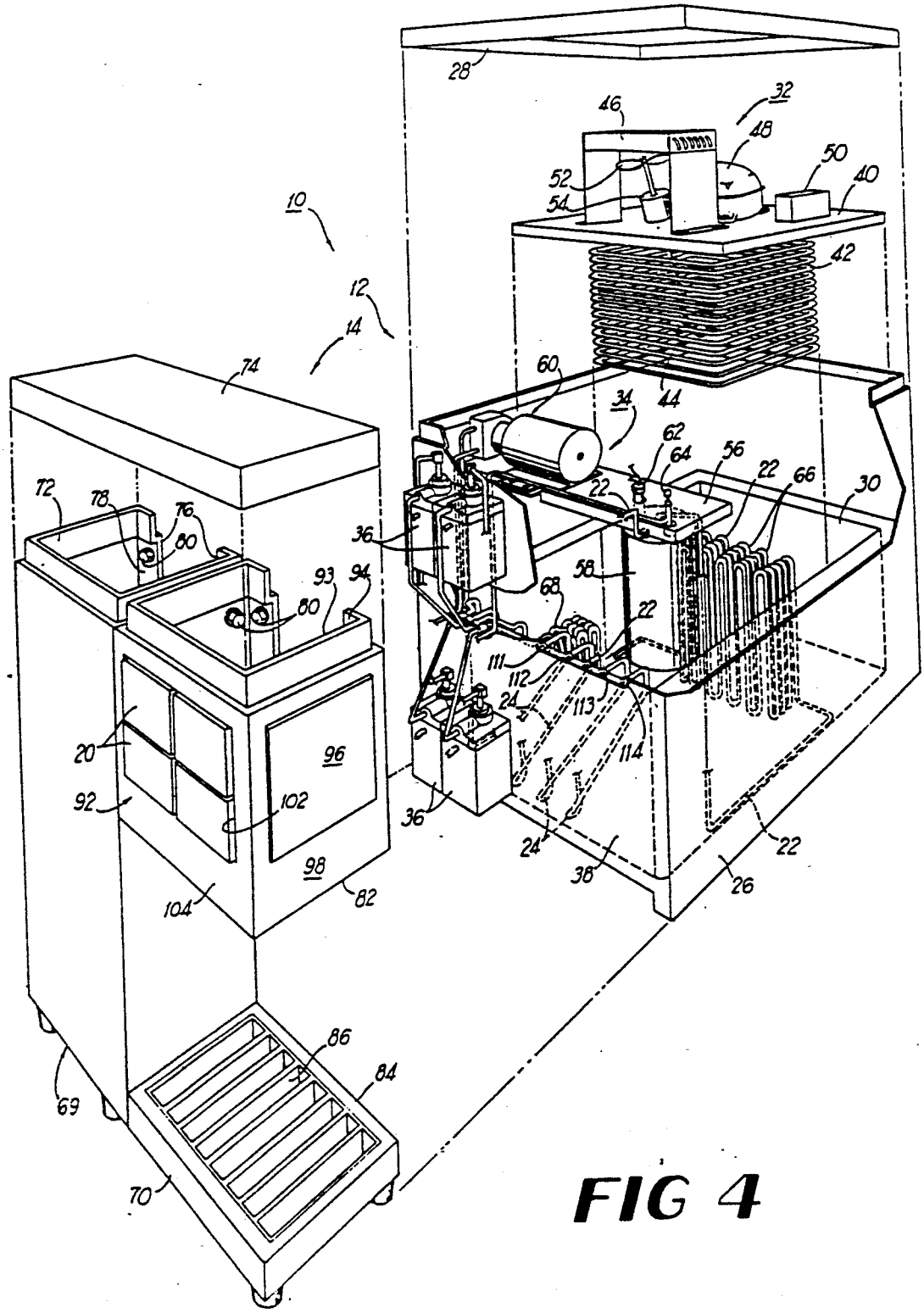
FIG. 4 is an exploded, partly broken-away, perspective view of the dispenser of FIG. 1.
Figure 5:
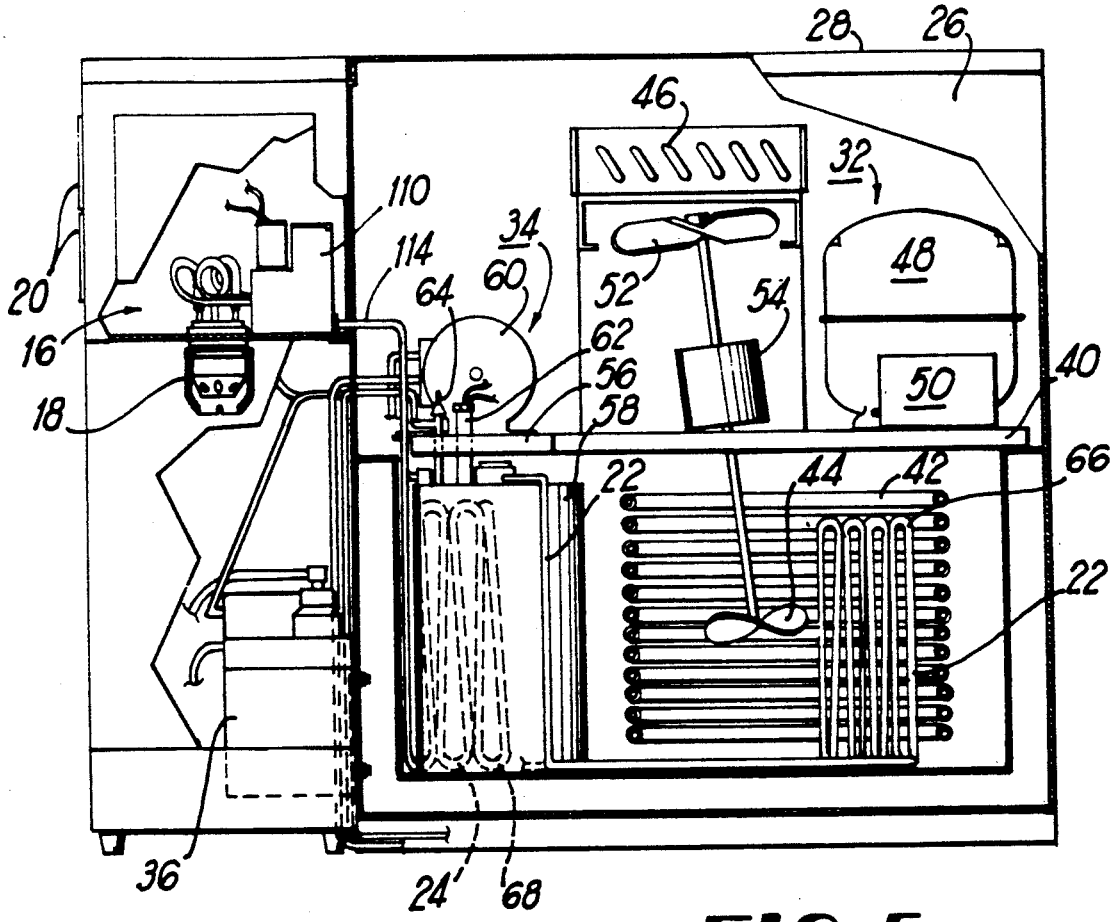
FIG. 5 is a partly cross-sectional side view of the convertible dispenser of FIG. 1.
Figure 6:
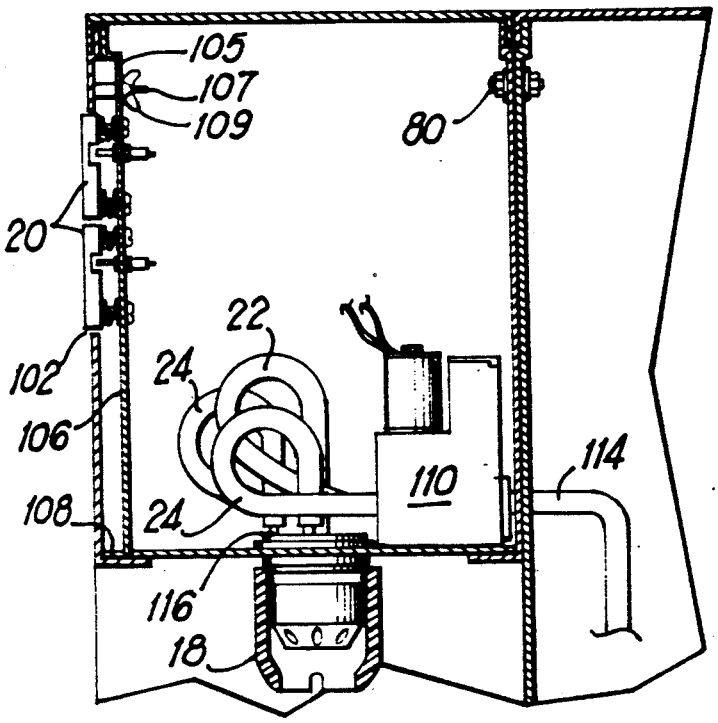
FIG. 6 is a partly cross-sectional, partial side view of the dispenser of FIG. 1.
Figure 7:
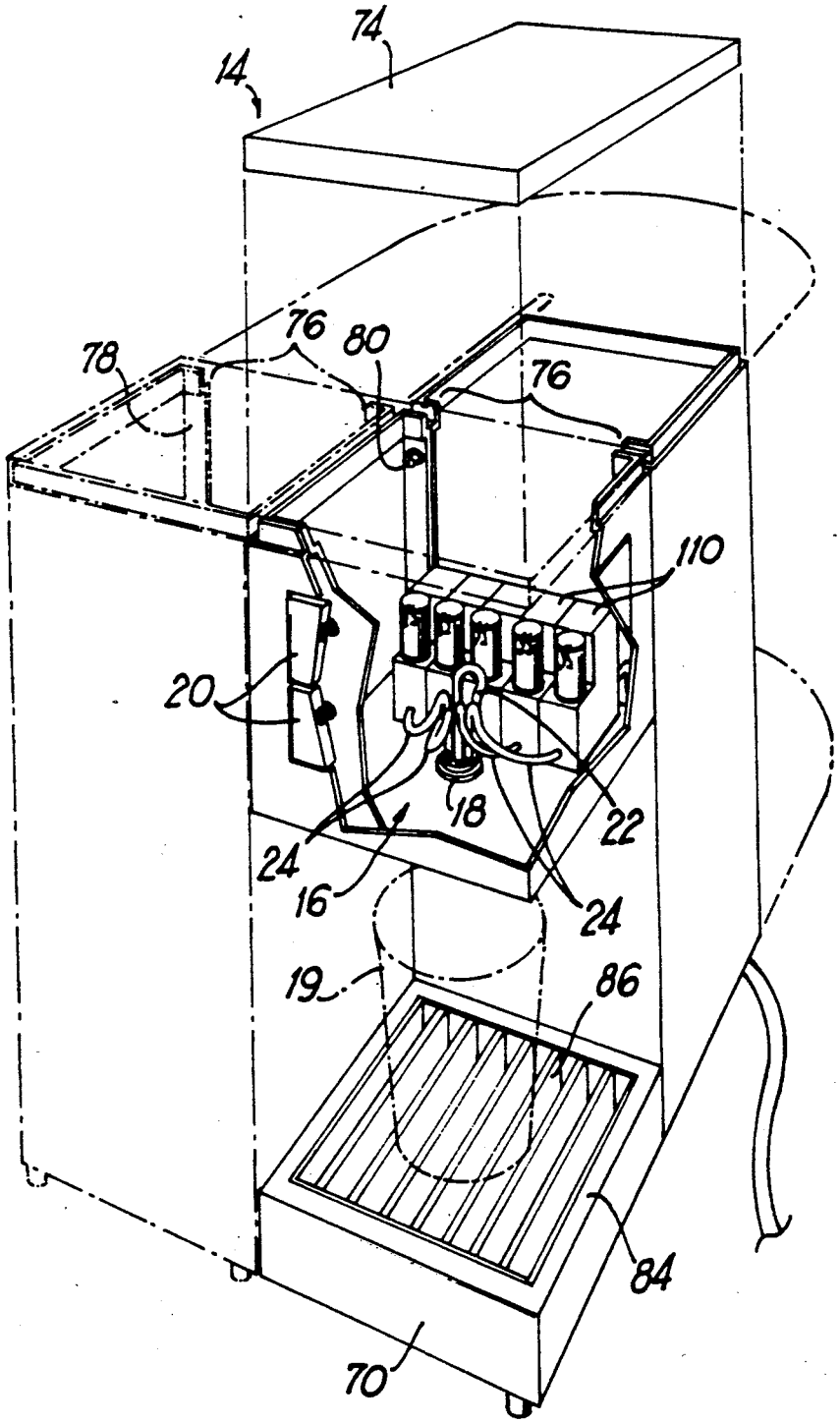
FIG. 7 is a partly broken away perspective view of the dispense module showing how it is converted to the FIG. 3 mode of operation.

A low cost, compact, versatile, multiflavor, postmix, convertible beverage dispenser which can be oriented in any one of several different ways to fit into any available space in an outlet. If an outlet has room for a dispenser, this dispenser will fit. This advantage can be used to reduce the inventory of different sizes of dispensers presently needed to accommodate different outlets.

This dispenser can be oriented frontways or sideways by an easy change in the location of the selector buttons. Alternatively, this unitary dispenser can be separated into a dispense module and a refrigeration module. The refrigeration module can be located below the counter and the dispense module can fit into a very small place on a counter.

This convertible dispenser can be used with figals or can be used with bag-in-box with built-in syrup pumps. In addition, this convertible dispenser can be easily modified to dispense different numbers of beverages.

DETAILED DESCRIPTION OF THE PREFERRED EMBODIMENTS

With reference now to the drawings, FIGS. 1–10 show one embodiment of the convertible beverage dispenser 10 of the present invention.

The dispenser 10 includes a refrigeration module 12 and a separate dispense module 14 which is removably attached to the refrigeration module. In the preferred embodiment shown, the dispenser 10 has a single multiflavor valve 16 with a single mixing and dispensing nozzle 18 for dispensing a beverage into a cup 19 (FIG. 7), carbonated water line 22 and four syrup lines 24. The dispensing valve 16 is in a notched corner of the dispenser 10 with the buttons on either of the adjacent walls.

The dispenser 10 as shown in the drawings is set up for use with bag-in-box syrup containers (not shown), although it can also be used with figals (not shown).

The dispenser 10 can be set up for operation on a countertop 11 (see FIG. 3) in any one of the three modes of operation shown in FIGS. 1, 2 or 3. To convert between the modes shown in FIGS. 1 and 2, it is only necessary to move the buttons 20 to change places with the panel 96. To convert from either the FIG. 1 or 2 mode to the FIG. 3 mode, a small conversion kit is used. The dispense module 14 is separated from the refrigeration module 12 and slightly rearranged (FIG. 7), the longer water and syrup lines are attached, a different splash plate (flat instead of L-shaped) is attached, and preferably a recirculating pump 134 and line are connected.

The refrigeration module 12 includes a housing 26, a lid 28, an ice-water tank 30, a refrigeration unit 32, a carbonator unit 34, and four syrup pumps 36 mounted on the sidewall 38. The lid 28 has air inlet vents 13 in a front portion thereof and air outlet vents 15 in a rear portion thereof.

The refrigeration unit 32 is mounted on a refrigeration deck 40 that sits on top of the tank 30. The unit 32 includes the usual equipment such as an evaporator coil 42, an agitator 44, condenser coils 46*m* compressor 48, ice bank control 50, and cooling fan 52 operated by an agitator motor 54, The carbonator unit 34 is mounted on a carbonator deck 56 and includes the usual carbonator equipment including a carbonator tank 58, a water pump and motor 60, level controller 62, and $CO_2$ inlet 64.

The refrigeration module 12 also includes the usual water cooling coils 66 and four separate syrup cooling coils 68. The water goes to the pump 60, then to the water cooling soils 66, then to the carbonator tank 58 and then to the multiflavor valve 16. The syrup goes from a bag-in-box container (not shown) to one of the four syrup pumps 36, to a syrup cooling coil 68, and then to the multiflavor valve 16. Each pump 36 has a $CO_2$ inlet, a syrup inlet and a syrup outlet, for example, for a $CO_2$ operated pump.

The dispense module 14 has a longer sidewall and shorter frontwall and includes a dispense module housing 69, a dispense section 70, a separate hollow section 72, and a lid 74. The hollow section 72 is generally U-shaped with an opening 76 in its rear wall 78 to accommodate the syrup pumps 36, in the modes of operation shown in FIGS. 1 and 2. The hollow section 72 is attached by bolts and nuts 80 to the refrigeration module housing 26.

The dispense section 70 includes separate upper and lower portions 82 and 84, respectively, and an L-shaped splash guard 88 in FIGS. 1 and 2, and a flat splash guard 90 in FIG. 3. The lower portion is the drip tray unit and includes the drip tray 85 and the cup rest 86. The drip tray unit can be connected to the hollow section 72 and/or to the refrigeration module 12.

The upper portion 82 includes a shell 92 having an open top 93 and an open rear wall 94. The shell 92 is bolted to both the refrigeration module housing 26 and to the hollow section 72 by bolts and nuts 80.

The upper portion 82 includes the selector buttons 20, a panel 96, and the single multiflavor valve 16. In the arrangement of FIG. 1 when the dispenser 10 is arranged frontways, the selector buttons 20 are placed in an opening 100 in a frontwall 98 of the dispense module 14, and the panel 96 is placed in an opening 102 in the sidewall 104. In the mode of operation shown in FIG. 2, the selector buttons 20 are placed in the sidewall opening 102 and the panel 996 is placed in the frontwall opening 100. In the separated arrangement of FIG. 3, the selector buttons 20 are placed in the sidewall opening 102 as in FIG. 2.

The manner of changing the selector buttons 20 and panel 96 will now be described. The openings 100 and 102 are identical in size and the buttons and panel can be handled through the open top 93 (with the lid 74 off). Each of the panel and buttons use connected to an identical mounting plate 106, so a description of one will suffice. The plate 106 has a flange 108 along its bottom edge that fits in a groove, and the plate has a single slot 105 centrally located in its top edge to receive a bolt 107 connected to the wall and on which a wing nut 109 is attached. The wires from the solenoids of the flow control modules 110 to the buttons 20 are flexible and easily allow movement of the buttons from one wall to the other.

The multiflavor valve 16 will now be described. The valve 16 includes the single nozzle 18 and a plurality of separate, identical flow control modules 110, shown in FIG. 10. One of the flow control modules 110 is for carbonated water an there are four separate syrup modules 110, one for each of four syrups. A water line 112 extends from the water flow control module 110 to a central opening in the nozzle 18, while the four syrup lines 111, 112, 113, and 114 extend from a respective one of the flow control modules 110 to a respective one of the circumferentially arranged openings 116 in the top of the nozzle 18.

Figure 8:
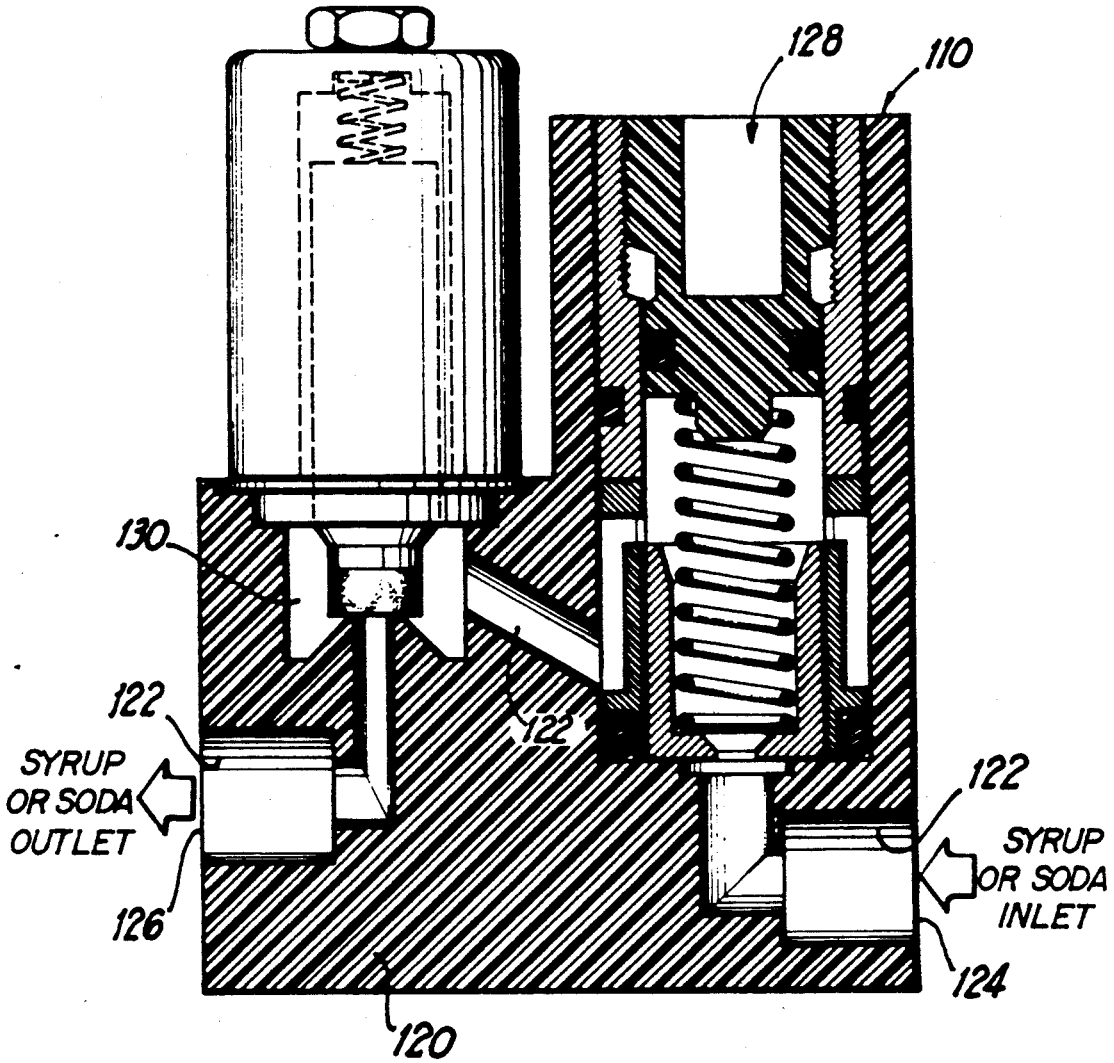
FIG. 8 is a cross-sectional view through the flow control module of this invention.

Referring to FIG. 8, each of the flow control modules 110 includes a body 120 and a liquid passageway 122 therethrough from an inlet port 124 to an outlet port 126. A standard piston-spring flow control 128 is located in the passage. A solenoid controlled valve 130 (including a solenoid, an armature, and a valve element movable onto and off of a valve seat) controls the on-off flow through the module 110. An advantage of this module is the fact that the inlet and outlet ports are on opposite faces and have passageways whose axes are parallel, to provide ease of installation.

The operation of the two arrangements shown in FIGS. 1 and 2 will thus be clear from the above description. If only a very small countertop space is available, then the dispenser 10 can be converted to a two-piece unit shown in FIG. 3 with only the very narrow dispense module placed on top of the countertop 11.

Figure 10:
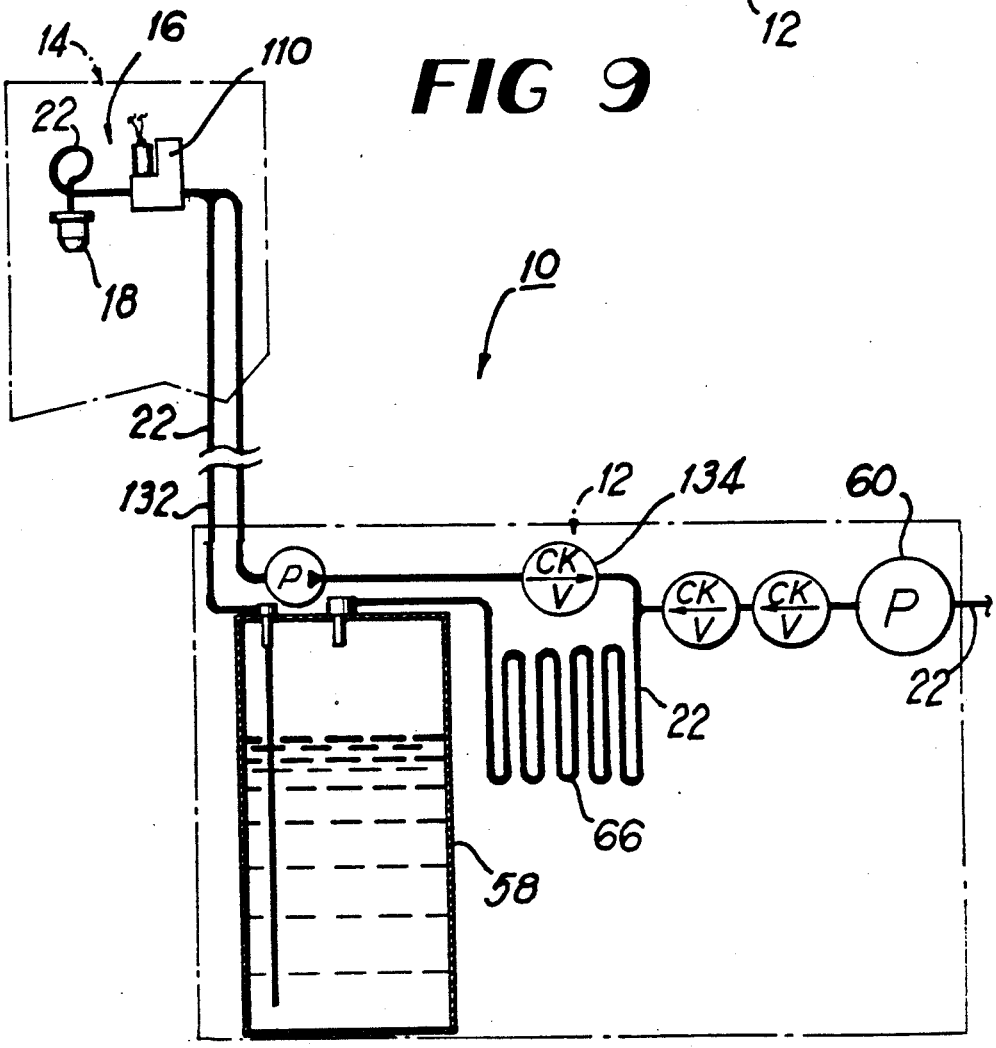
FIG. 10 is a diagrammatic view showing the water connection when the dispense module is separated from the refrigeration module.

This conversion from a one to two-piece unit can be easily done in the field with the aid of a small breakaway conversion kit containing the long water and syrup lines 132, a recirculating water pump 134 to be mounted on the refrigerator module housing 26, and a flat splash plate 90. To do the conversion, the lids are removed, the bolts and nuts 80 are removed, the recirculating water pump 134 is mounted on the housing 26, and the lines 132 are installed. In addition, the two sections 70 and 72 of the dispense unit are disconnected and then re-connected, using bolts and nuts 80 as shown in FIG. 10. In this way, the openings in their rear walls are facing each other and the dispense module has a smooth, clean, exterior surface. The drip tray is not connected to the shell 92, but its is connected to a drip tray support that is connected to the hollow section 72 and that extends under both sections 70 and 72 of the dispense module as shown in FIGS. 1 and 2. This support is disconnected from the hollow section 70 and then reconnected to extend under the drip tray in FIG. 3.

Figure 9:
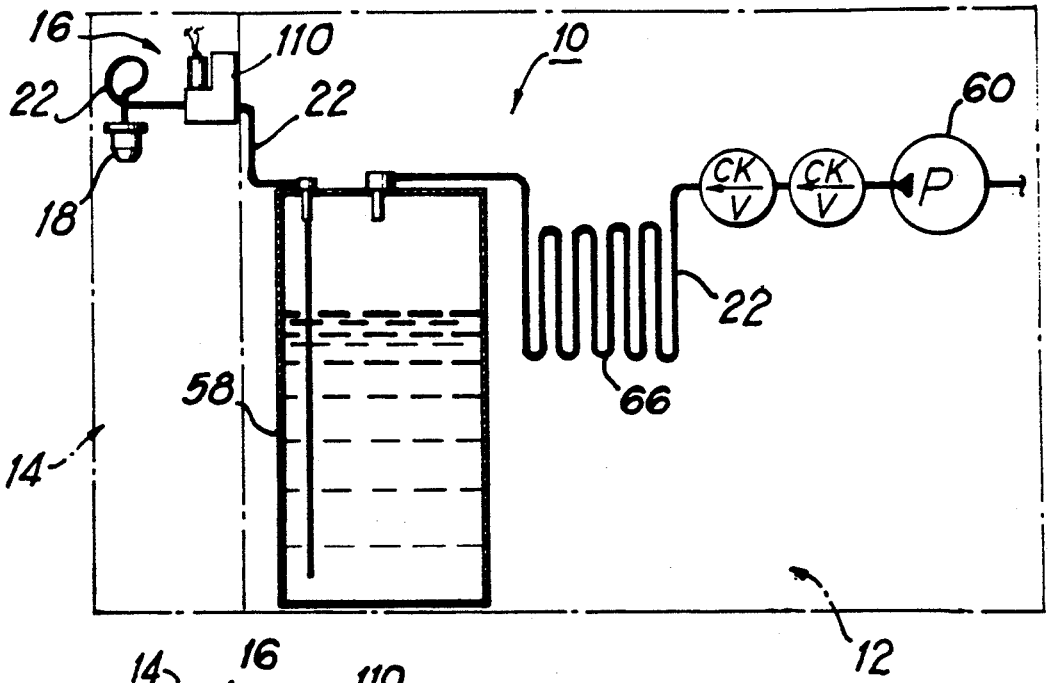
FIG. 9 is a diagrammatic view showing the water connection when the dispense module connected to the refrigeration module.

FIG. 9 shows the standard set up for the water line for the FIGS. 1 and 2 modes of operation, and FIG. 10 shows the additional recirculating water line set up for the FIG. 3 mode of operation. This provides cold water for the dispenser at all times.

Figure 11:
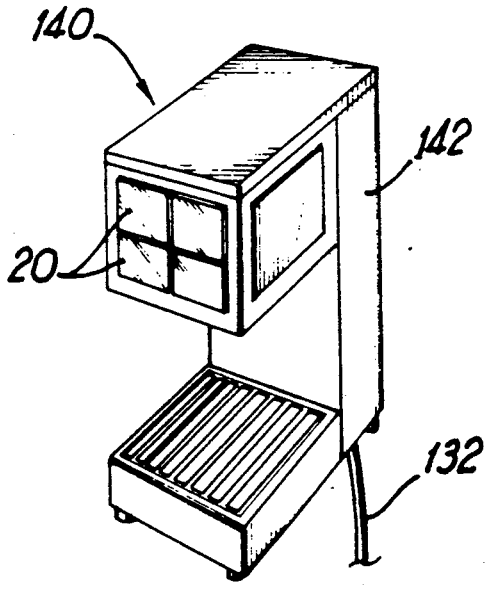
FIG. 11 is a perspective view similar to FIG. 3 but of another embodiment that requires much less space.

FIG. 11 shows a dispense module 140 according to another embodiment similar to FIG. 3 except that the hollow section 72 is replaced (along with a different lid and drip tray support) with a different hollow section 142 having much less depth than does section 72. This embodiment would be used where only a very small countertop space is available.

Figure 12:
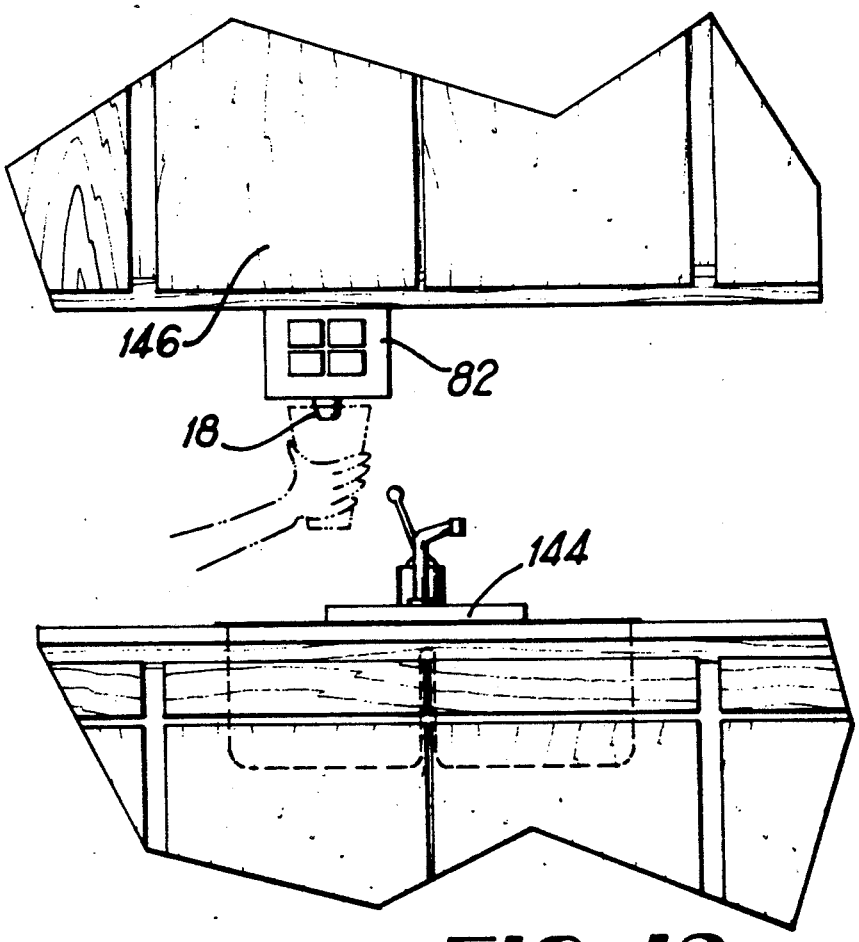
FIG. 12 is a front view of the dispense module according to a still further embodiment of this invention.

FIG. 12 shows another embodiment of this invention wherein the upper portion 82 of the dispense section 70 of the dispense module 14 is used by itself, by connecting it above a sink, such as under an existing cabinet (it can alternatively be wall mounted).

FIGS. 13–25 show a preferred embodiment of a convertible dispenser 210 of the present invention. The dispenser 210 is similar to the dispenser 10 described above with the following differences described below with reference to FIGS. 13–25.

Figure 13:
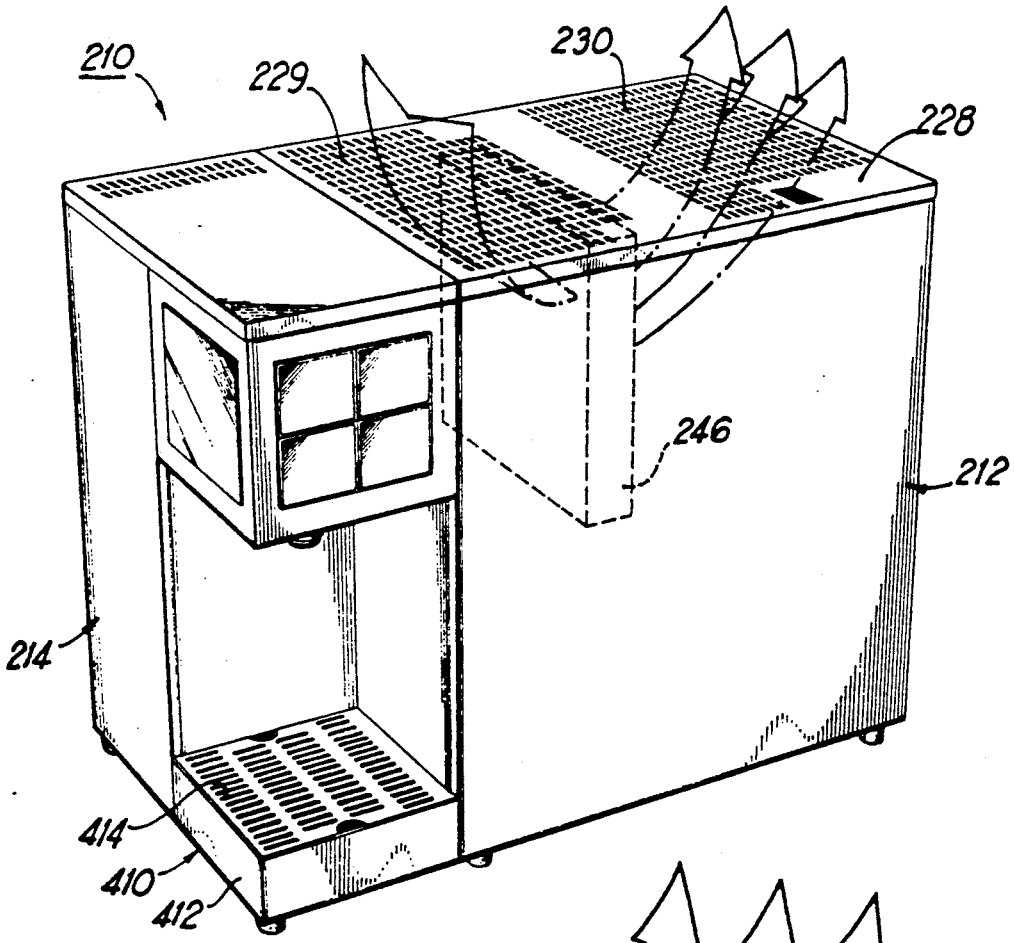
FIG. 13 is a perspective view of the preferred embodiment of the convertible dispenser of the present invention.
Figure 14:
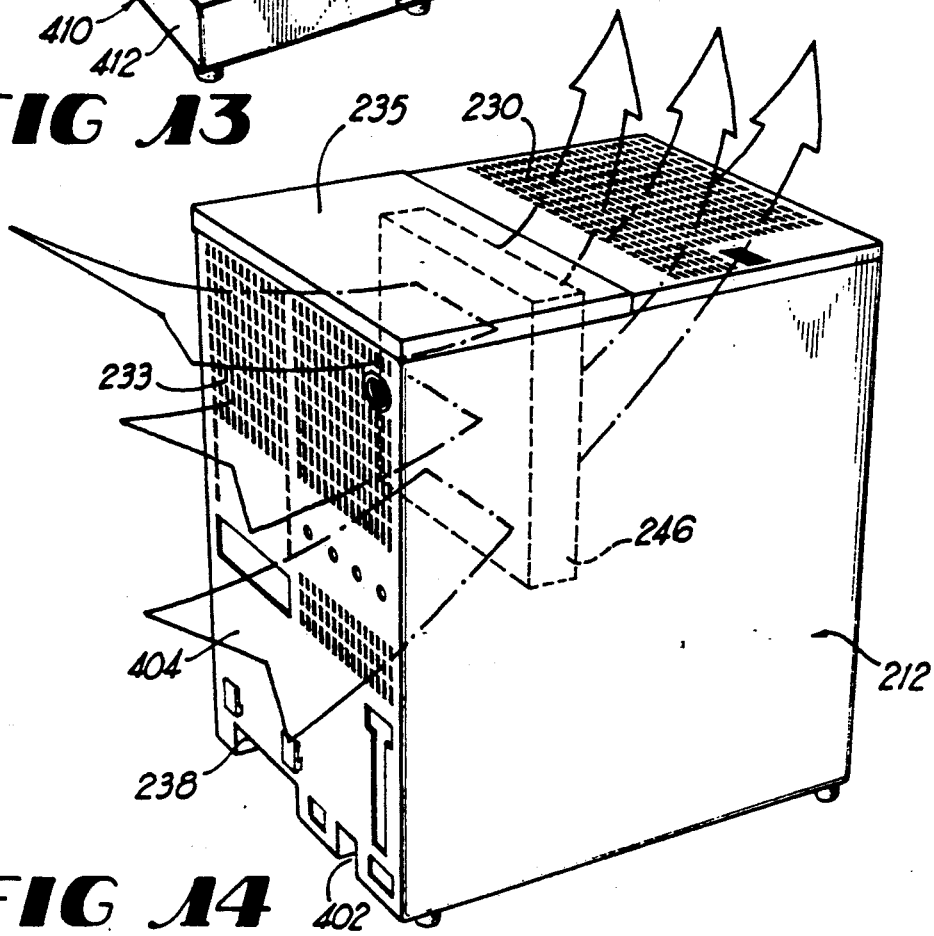
FIG. 14 is a perspective view of the refrigeration module of the convertible dispenser of FIG. 13.

FIGS. 13 and 14 show the air vent arrangement of the dispenser 210. The dispenser 210 includes a lid 228 having air inlet vents 229 and air outlet vents 230 in a front portion and in a rear portion, respectively, of the lid 228. The refrigeration module 212 includes air inlet vents 233 in the upper portion of the sidewall 238.

When the refrigeration module 212 is attached to the dispense module 214, air flows into the refrigeration module 212 through the air inlet vents 229, through the condenser 246, and out through the air outlet vents 230. When the modules 212 and 214 are separated, however, the refrigeration module 212 may often be located in a confined space and the air flow could go directly from the air outlet vents 230 into the inlet vents 229. This would cause the compressor motor to run more often, wear out more quickly and could raise the drink temperature. Therefore, in this situation, the inlet vents 229 are covered by a plate 235 (of metal, wood or plastic, for example) and the air then flows in the air inlet vents 233 and out the air outlet vents 230. It has been found that this arrangement with the plate 235 avoids the problem mentioned above.

Figure 15A:
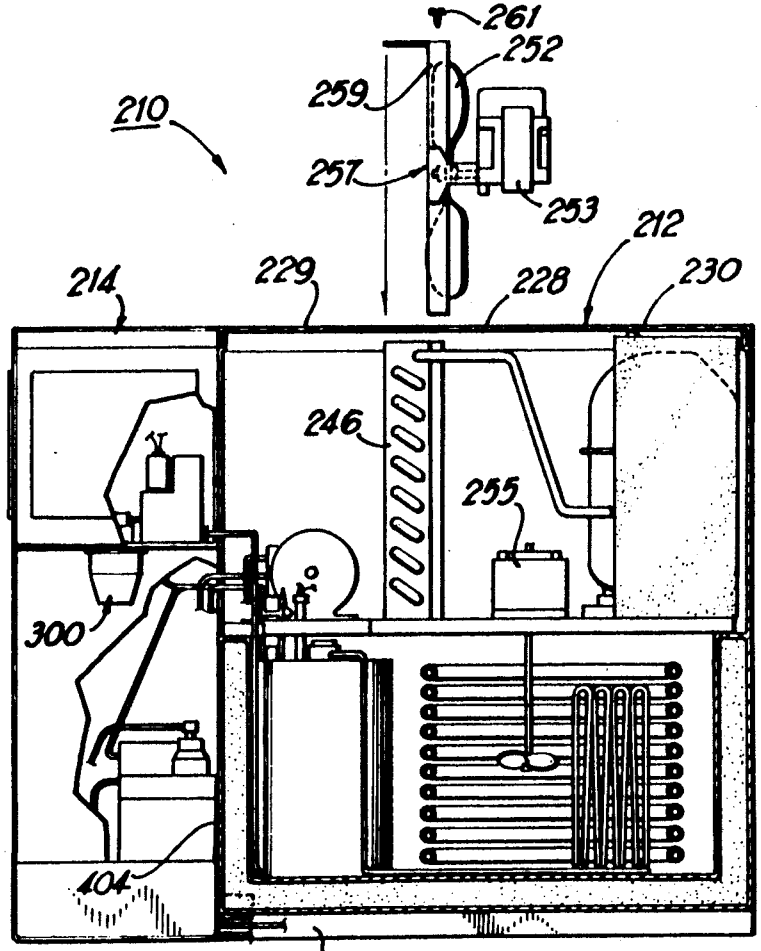
FIG. 15A is a partially exploded, cross-sectional side view like FIG. 15 but showing the modular condenser-fan and motor unit removed.
Figure 15:
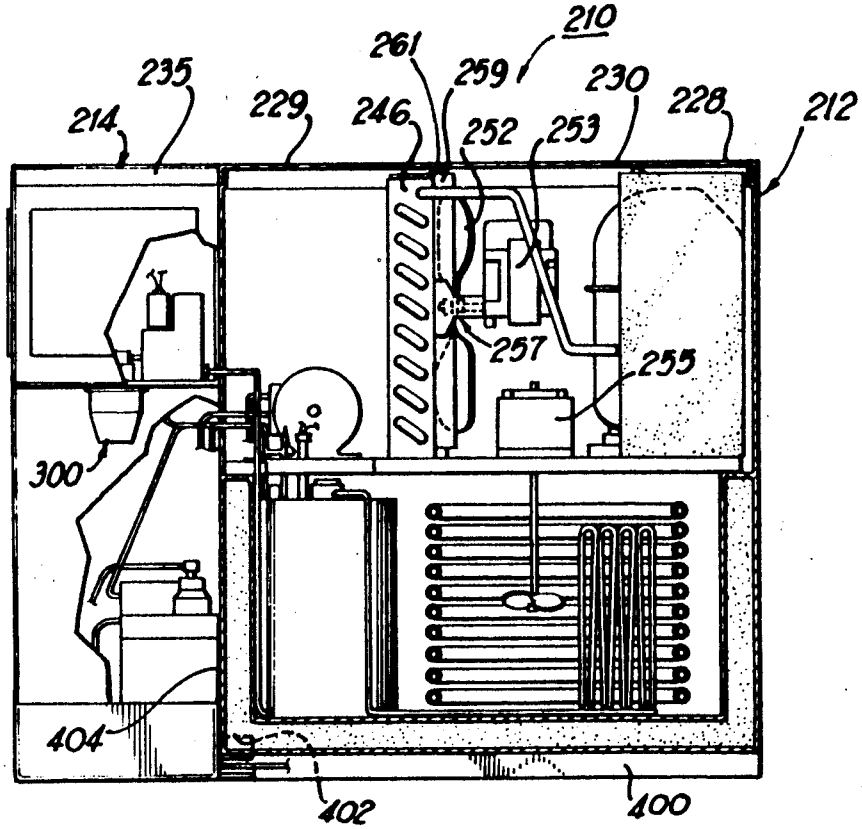
FIG. 15 is a partly cross-sectional side view of the dispenser of FIG. 13.

FIGS. 15 and 15A show the preferred arrangement of the refrigeration module 212 including a condenser 246 (or condenser coil), a cooling fan 252, a cooling fan motor 253, and a separate agitator motor 255. The fan and fan motor are mounted together as an integral, easily removable modular unit 257, including a bracket 259 which is held in place by two screws 261. This arrangement permits the use of a larger condenser than in the dispenser 10.

By simply removing the two screws 261, the entire unit 257 can be easily slid out directly upwardly out of the dispenser 210 (after removing the lid 228). This also provides easy access to the agitator motor 255 and other components including a transformer mounted adjacent the motor 255. This feature is important because the dispenser 210 does not have a separate bonnet (or top half of the housing) as do many countertop dispensers, so access has to be through the top opening when the lid is removed. Thus, although the dispenser 210 is small and compact, the internal components are easily accessible while the outside shell has a smooth, clean, and continuous surface providing a large advertising surface and a neat appearance.

Figure 16:
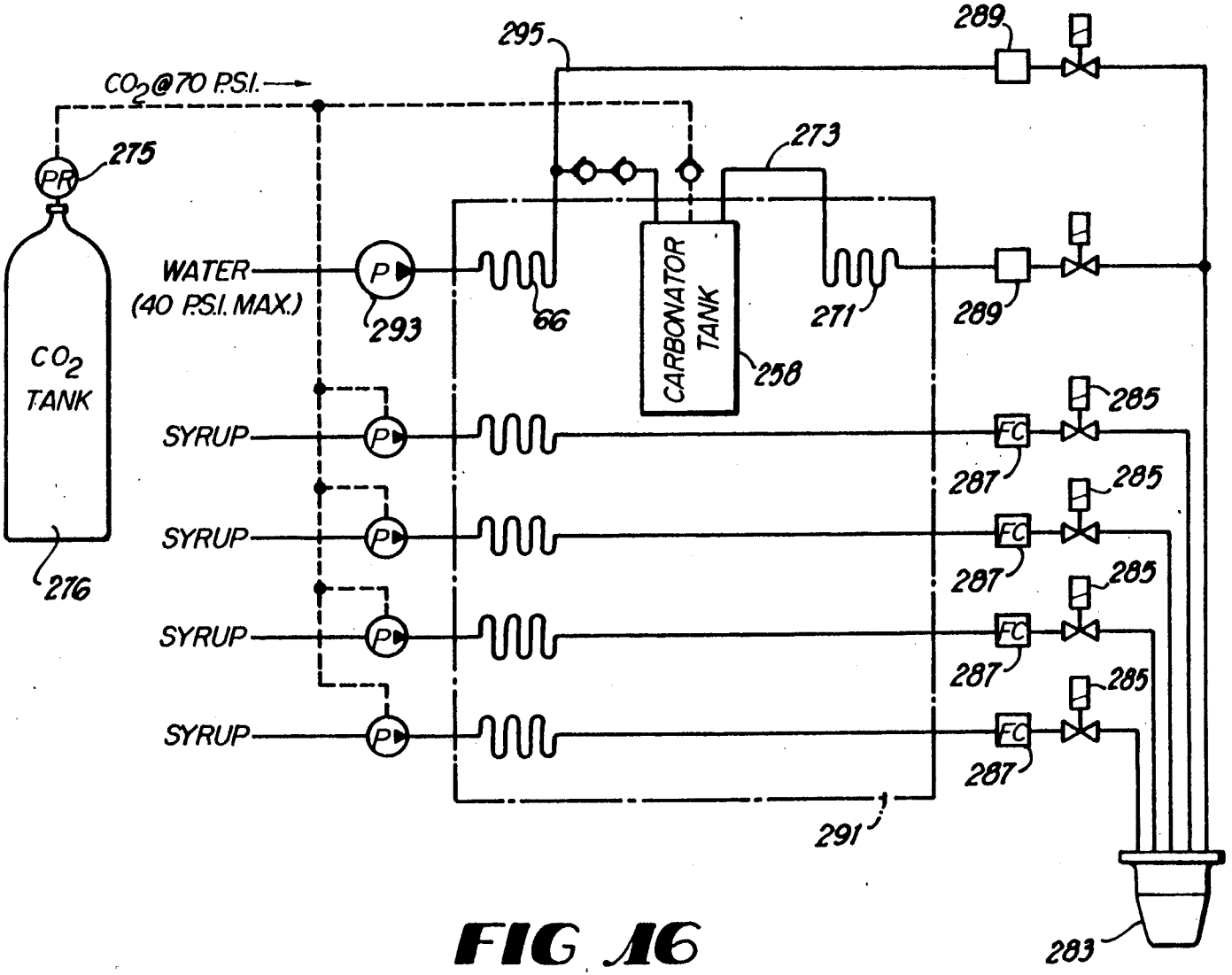
FIG. 16 is a partly diagrammatic, partly schematic flow diagram showing the water and syrup circuits in the dispenser of FIG. 13 when the dispense and refrigeration modules are connected.
Figure 17:
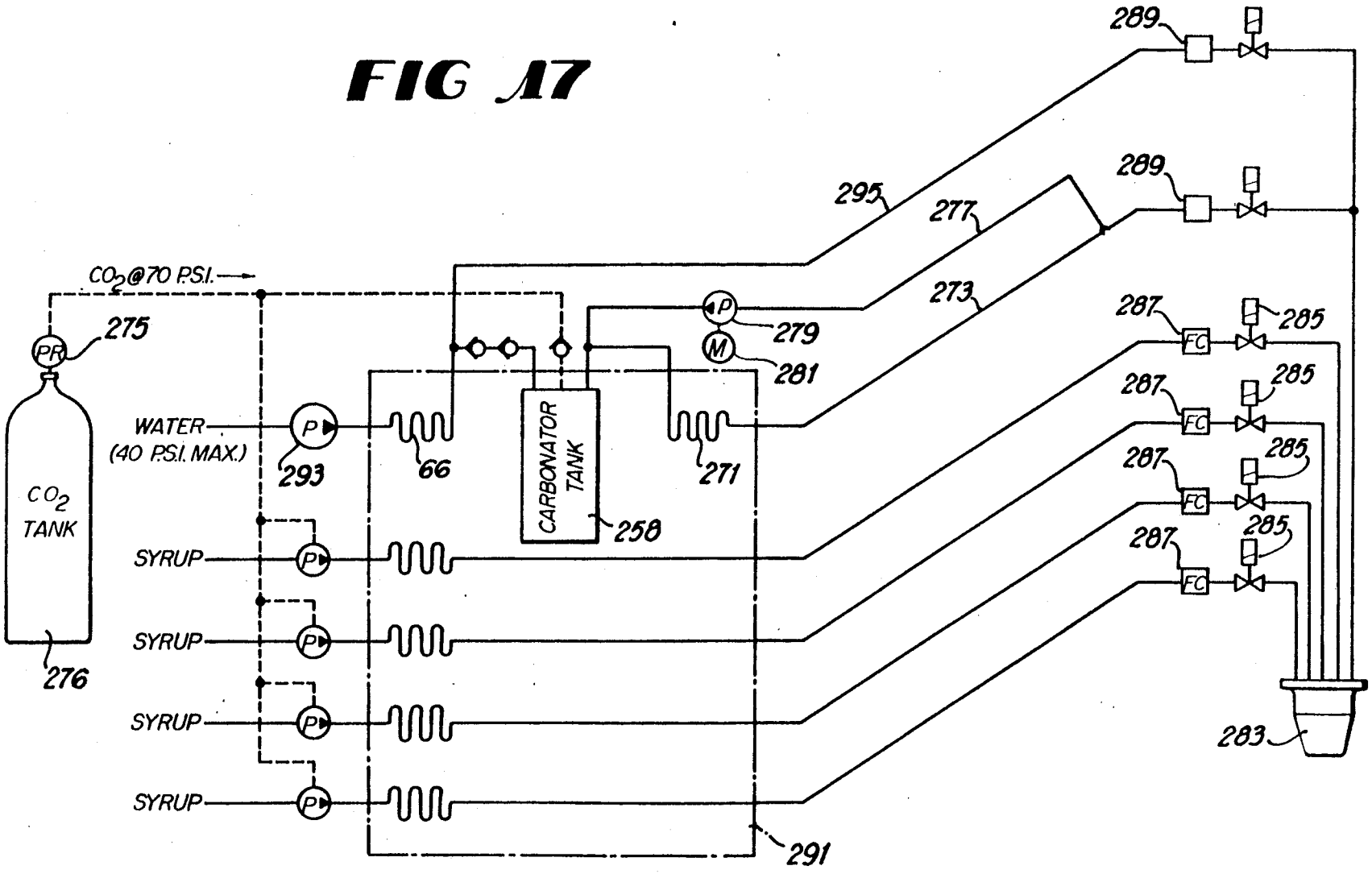
FIG. 17 is a partly diagrammatic, partly schematic flow diagram showing the water and syrup circuits in the dispenser of FIG. 13 when the two modules are separated.
Figure 18:
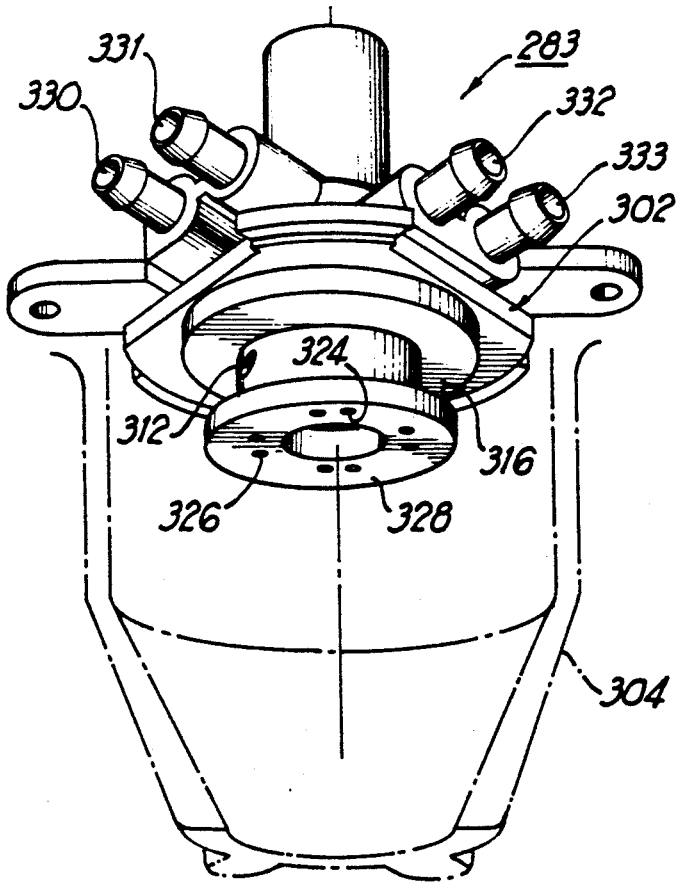
FIG. 18 is a partly cut-away bottom perspective view of the nozzle and spout.
Figure 19:
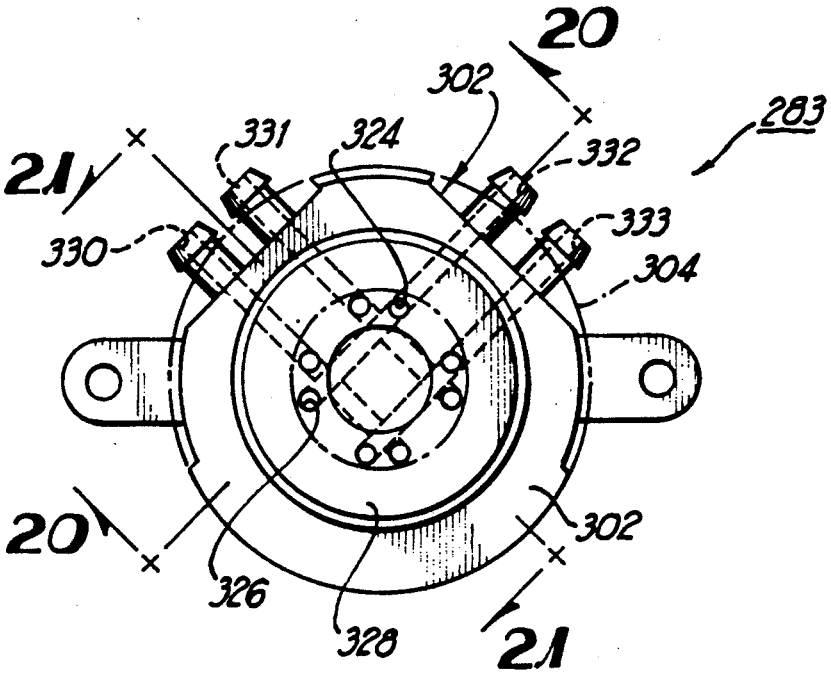
FIG. 19 is a bottom plan view of the nozzle.
Figure 21:
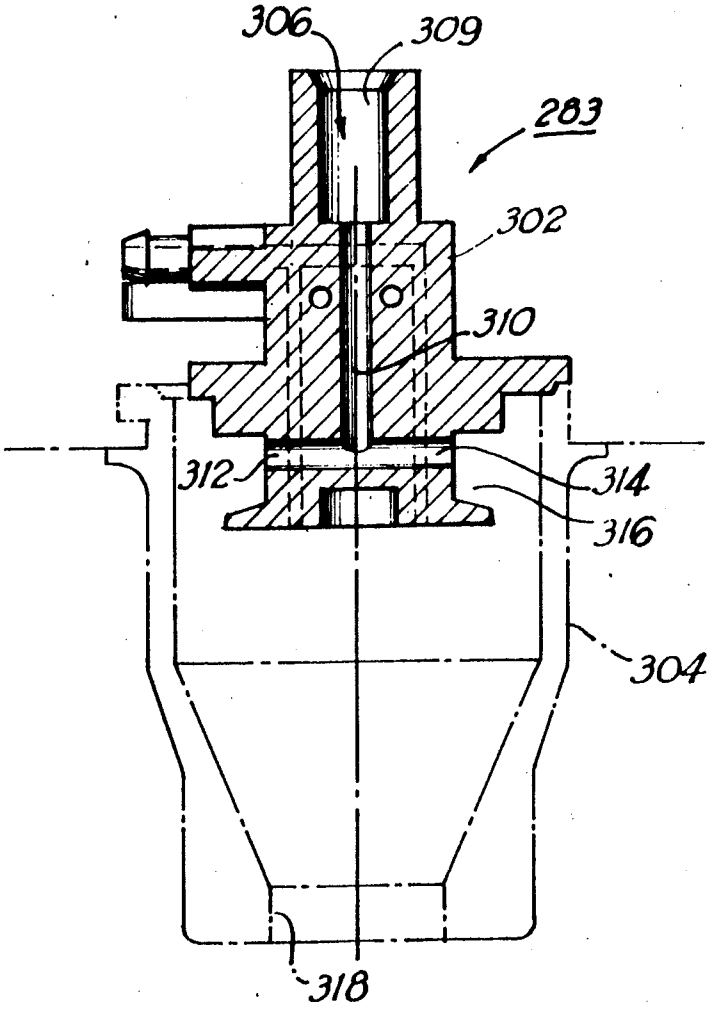
FIG. 21 is a cross-sectional side view of the nozzle taken along line 21—21 of FIG. 19.
Figure 20:
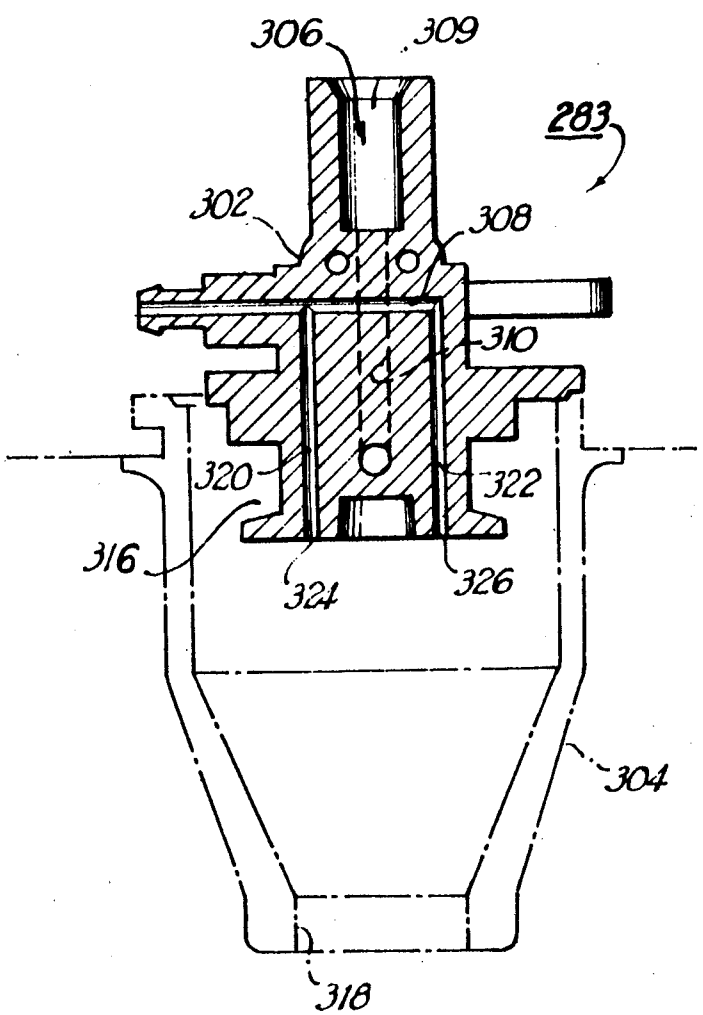
FIG. 20 is a cross-sectional side view of the nozzle taken along line 20—20 of FIG. 19.

FIGS. 16 and 17 show the water and syrup circuits for the dispenser 210, both when the two modules are connected and when they are separated. FIGS. 16 and 17 both show a cooling coil 271 in the soda line 273 downstream from the carbonator tank 258. The dispenser 210 also has the precooling coil 66 as shown in FIGS. 9 and 10. This precooling coil 66 allows the use of a lower $CO_2$ pressure in the carbonator tank 258 and in fact the use of the same pressure in the tank 258 that is needed to operate the syrup pumps 36. This allows for the elimination of a separate $CO_2$ pressure regulator for the carbonator tank 258 and allows for the operation of the dispenser 210 with only the single $CO_2$ regulator 275 on the $CO_2$ cylinder 276.

FIG. 17 shows a recirculating soda line 277, a pump 279 and a motor 281 for driving the pump, for use when the modules are separated. It is noted that this recirculating line is entirely downstream from the carbonator tank 258. This pumping can be controlled to turn on and off as desired but is preferably left on continuously. This recirculating soda line provides a cold drink at all times, even through the refrigeration module is located some distance away from the dispense module.

In FIG. 17, all of the syrup and soda and plain water lines between the separated modules are preferably contained in an insulated python, normally about ten (10) feet long.

FIG. 17 also shows a multiflavor nozzle 300, solenoid valves 285, flow controls 287, flow washers 289, a chilled water bath 291, the carbonator tank 258, the $CO_2$ cylinder 276, the pressure regulator 275, the syrup pumps 36, the carbonator pump 293, and the plain water line 295. FIG. 16 shows the same components except for the recirculating soda system which is not used when the dispense and refrigeration modules are connected.

FIGS. 18–21 show the preferred nozzle 300 of the present invention used in the dispenser 210, including a nozzle body 302 and a spout 304. The nozzle body has a water passageway 306 therethrough and four separate syrup passages, one of which 308 is show in FIG. 20. The water goes straight down from a water inlet port 309 through an axial passage 310 in the nozzle body until it splits into two radial passages 312 and 314 at right angles to the axial passage 310. The passages 312 and 314 exit into an annular groove 316 from which the water hits the spout 304 and then flows down and out the spout opening 318. The four syrup passages are similar to each other and each start at a respective one of four separate syrup inlet ports 330, 331, 332 and 333 and continue through the nozzle body as described below for passage 308. The syrup passage 308 splits into two separate passages 320 and 322 and exit out two separated, spaced-apart, outlet openings 324 and 326 in a bottom wall 328 of the nozzle body 302. This nozzle provides improved mixing, less stratification in the beverage cup, and reduced flavor carryover. Any known method can be used to connect the spout to the nozzle such as a bayonet connection using two flanges on the spout.

Figure 25:
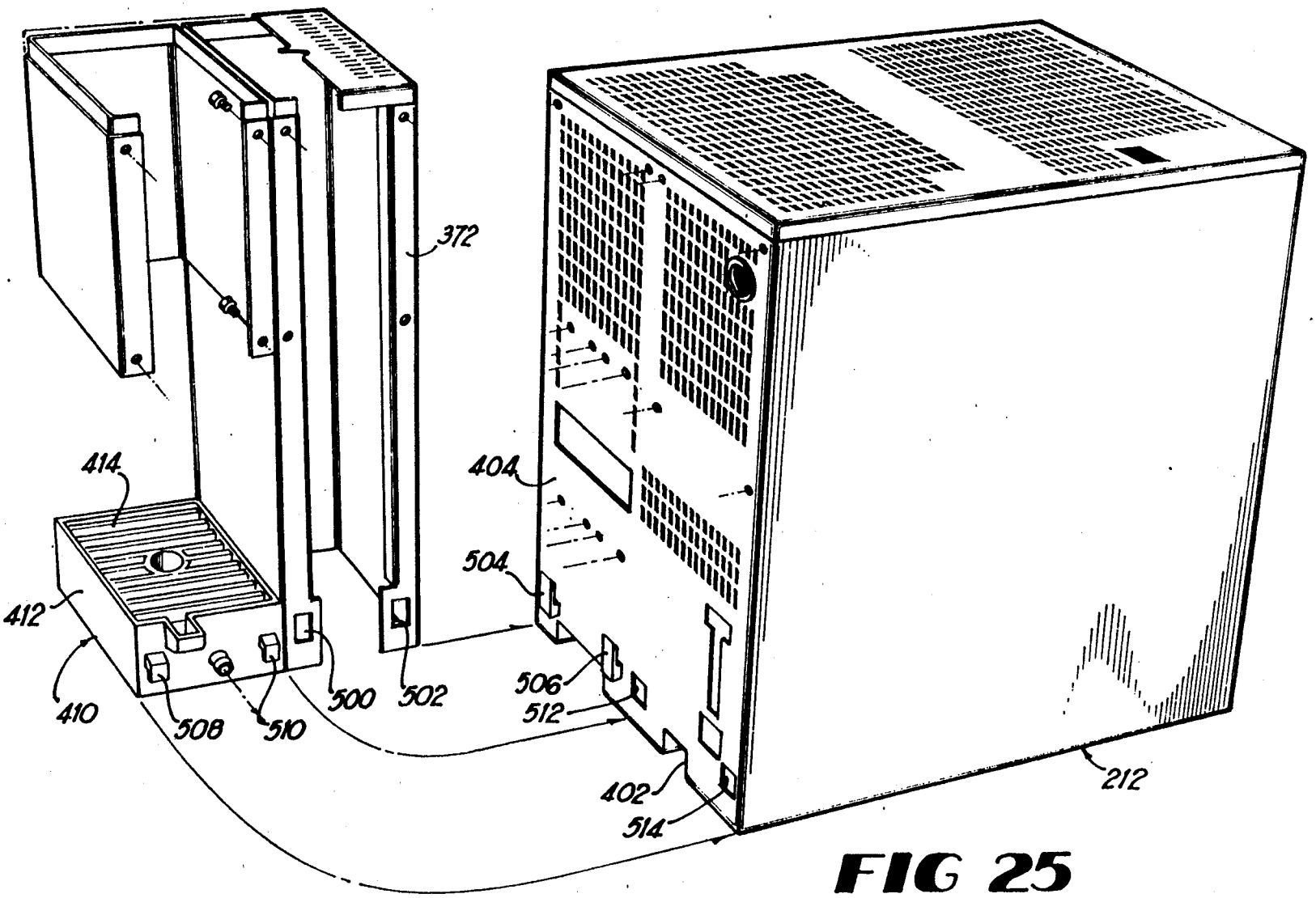
FIG. 25 is an exploded perspective view of the dispenser housings for the dispenser of FIG. 13 showing the connecting means therefor.

The hollow section 372 of the dispense module 214, referred to as the pump wrap because it covers the syrup pumps 36, can be easily removed to provide access to the syrup pumps by simply removing two screws 373 at the top thereof, and then lifting up to clear two pins from two holes at the lower end of the section 372. The same pin-hole arrangement is used to connect the drip tray unit 375 to the section 372 when the modules are separated. The pin-hole arrangement is shown in FIG. 25. The hollow section 372 has two holes 500 and 502 and the refrigeration module has two mating pins 504 and 506. The drip tray has two pins 508 and 510 and the refrigeration module has two mating holes 512 and 514. When the two modules are separated, the pins of the drip tray connect with the holes 500 and 502 in the hollow section 372.

The dispenser 210 does not use the separate drip tray support of the dispenser 10 of FIG. 1. When the two modules are connected, there is preferably no connection between the two sections of the dispense module.

The refrigeration module includes a recess 400 (see FIG. 15A) thereunder and a notch 402 in the sidewall 404 thereof to accommodate the $CO_2$ line, the water line and the syrup lines. All of these lines come up through the recess and then under the drip tray and into the hollow section.

The drip tray unit 410 includes the drip tray 412 and the cup rest 414.

The dispenser 210 can include legs, or not, as desired. If the refrigeration unit includes legs, then legs are also used on the dispense unit but preferably on the distal end thereof.

Figure 22:
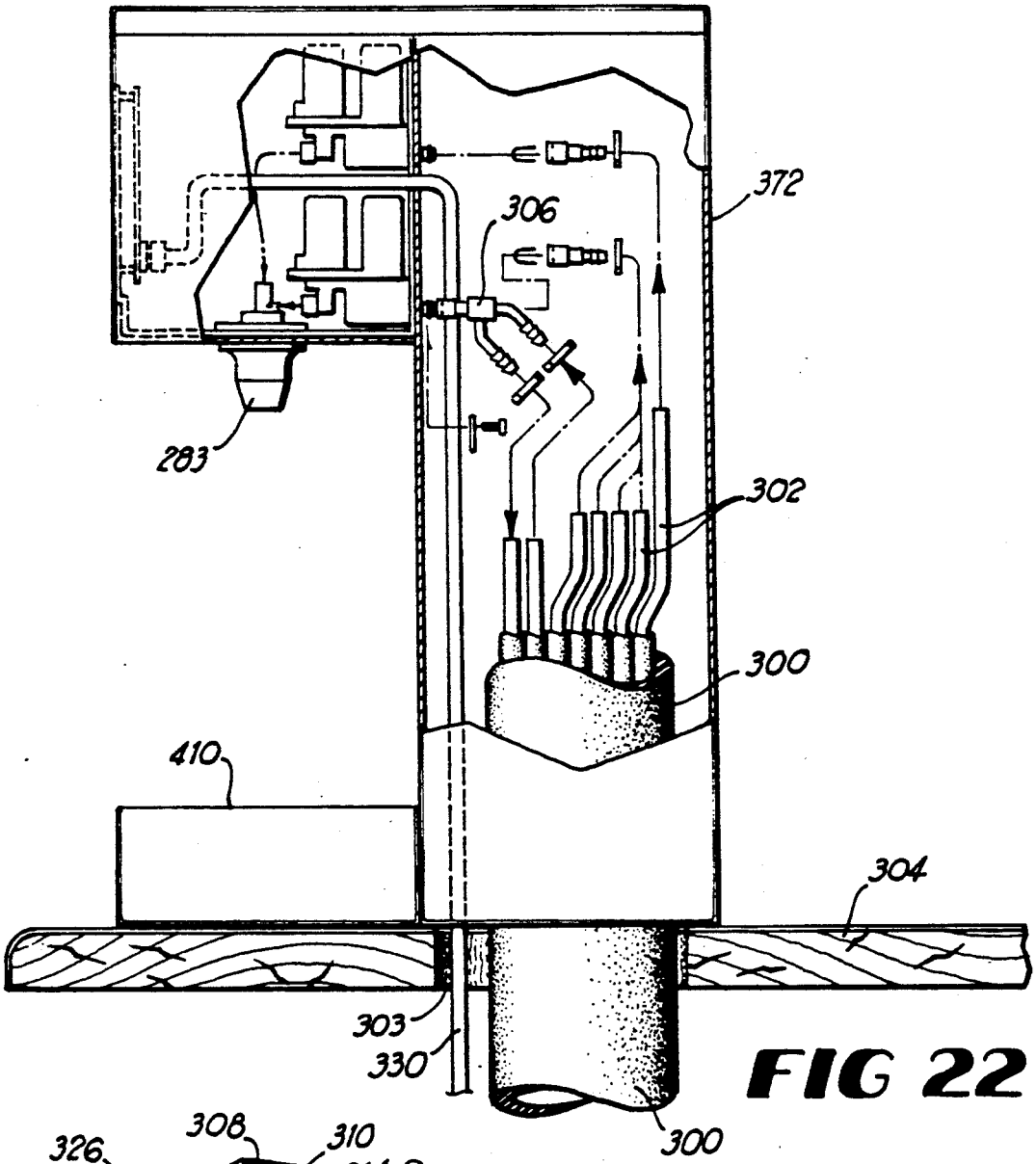
FIG. 22 is a partly cross-sectional side view of the dispense module of the dispenser of FIG. 13 and also showing one end of the python.
Figure 23:
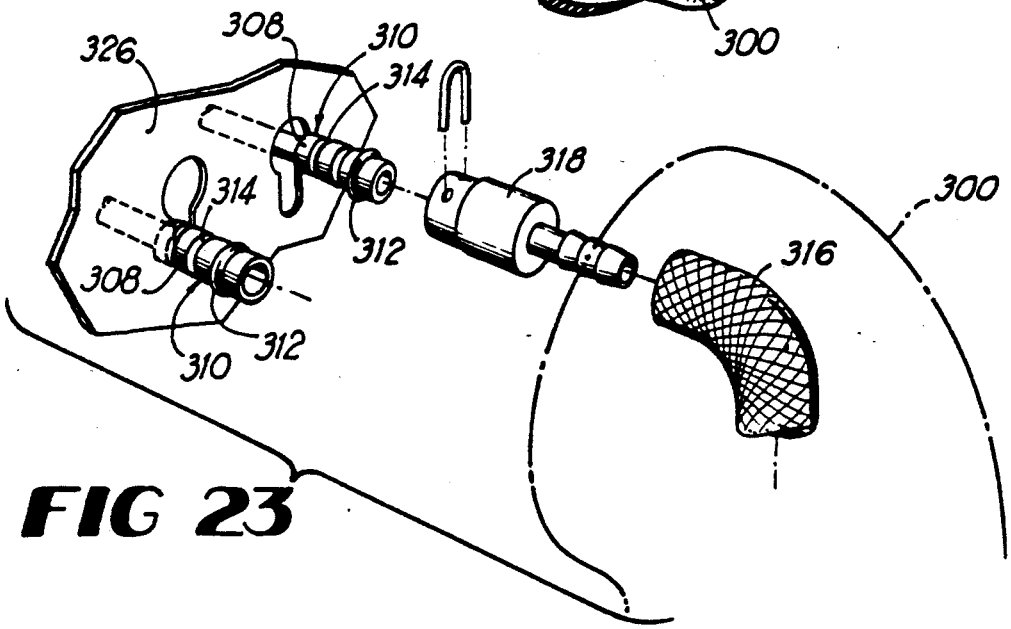
FIG. 23 is an enlarged, partial, exploded view showing certain details of the connectors.
Figure 24:
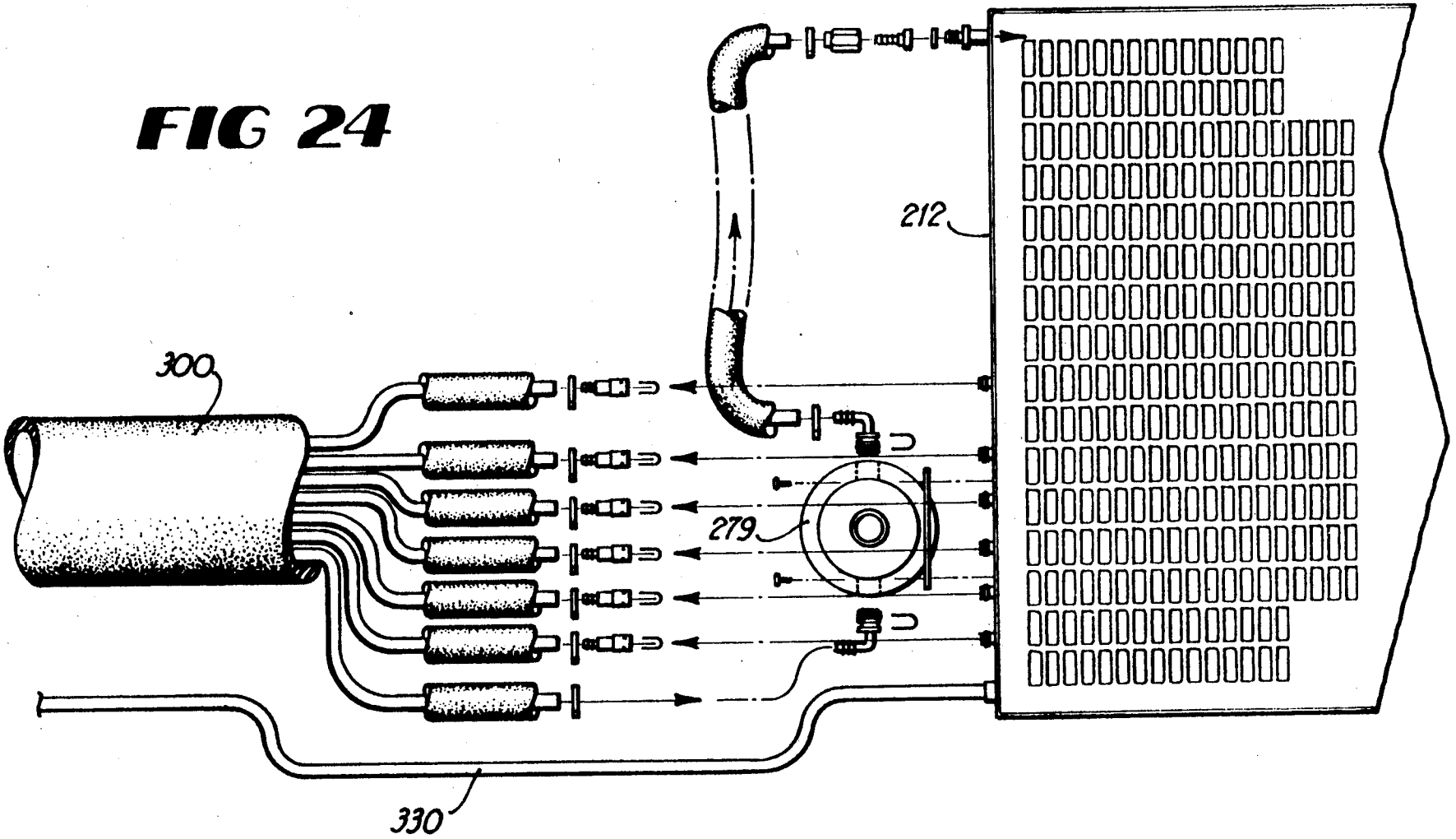
FIG. 24 is a partial, partially exploded top plan view of the refrigeration module 212 showing the connection to the other end of the python.

Referring now to FIGS. 22–24, these show certain connection details and the python 300. When the dispense and refrigeration modules are separated, as described above for both the embodiments of FIG. 1 and FIG. 13, the long syrup and water lines 302 are preferably encased in a long insulated tube or python 300. FIG. 24 shows the end of the python connected to the refrigeration module 212 and FIGS. 22 and 23 show the end connected to the dispense module 214. As shown in FIG. 22, the python preferably extends through a hole 303 in the counter 304 on which the dispenser sits. FIG. 22 shows the fitting 306 for the recirculating soda line 277.

As shown in FIG. 23 a conduit 308 that goes into the multiflavor valve has a fitting 310 with an o-ring 312 and a groove 314. The end of a flexible line 316 includes a mating coupling 318 that slides over the fitting 310. A pin 320 slides through two holes 322 in the coupling 318 and into the groove 314 to hold the line to the conduit 308. The valve 110 is held to the wall 326 by sliding the conduit 308 down in the Keyway 328 to lock the wall 326 between the fitting 310 and the rear of the valve 110. For simplicity, the valve 110 is not shown in FIG. 23. The connections to the refrigeration module at the other end of the python are made the same way, as shown in FIG. 24.

FIG. 24 also shows the return line and the pump 279 of the recirculating soda circuit. The pump 279 is mounted on the lower outside surface of the refrigeration module. The python extends up through the hollow section 72 of the dispense module 214. The electrical lines are in the cable 330.

Figure 26:
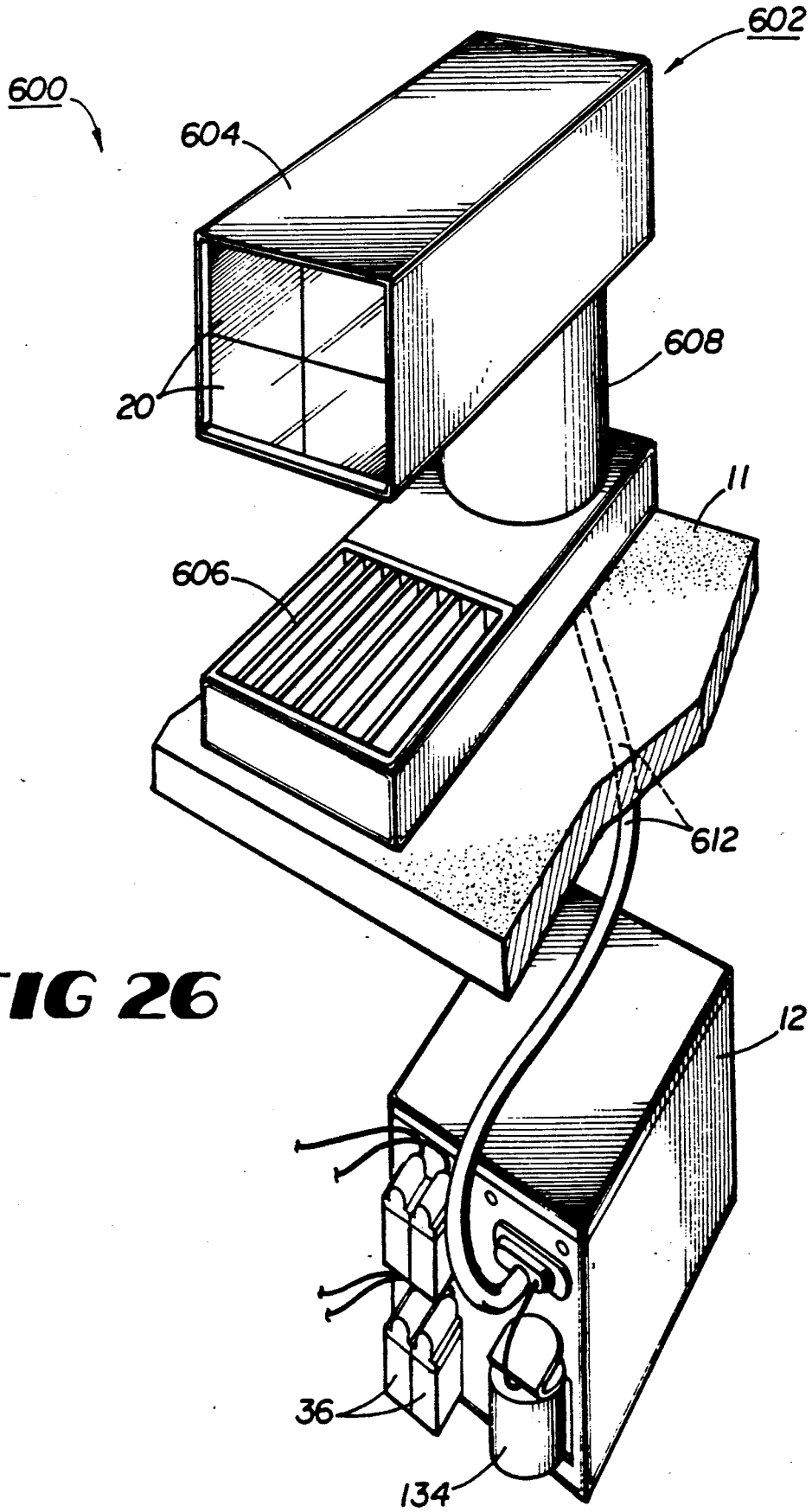
FIG. 26 is a perspective view of another embodiment of the present invention.
Figure 27:
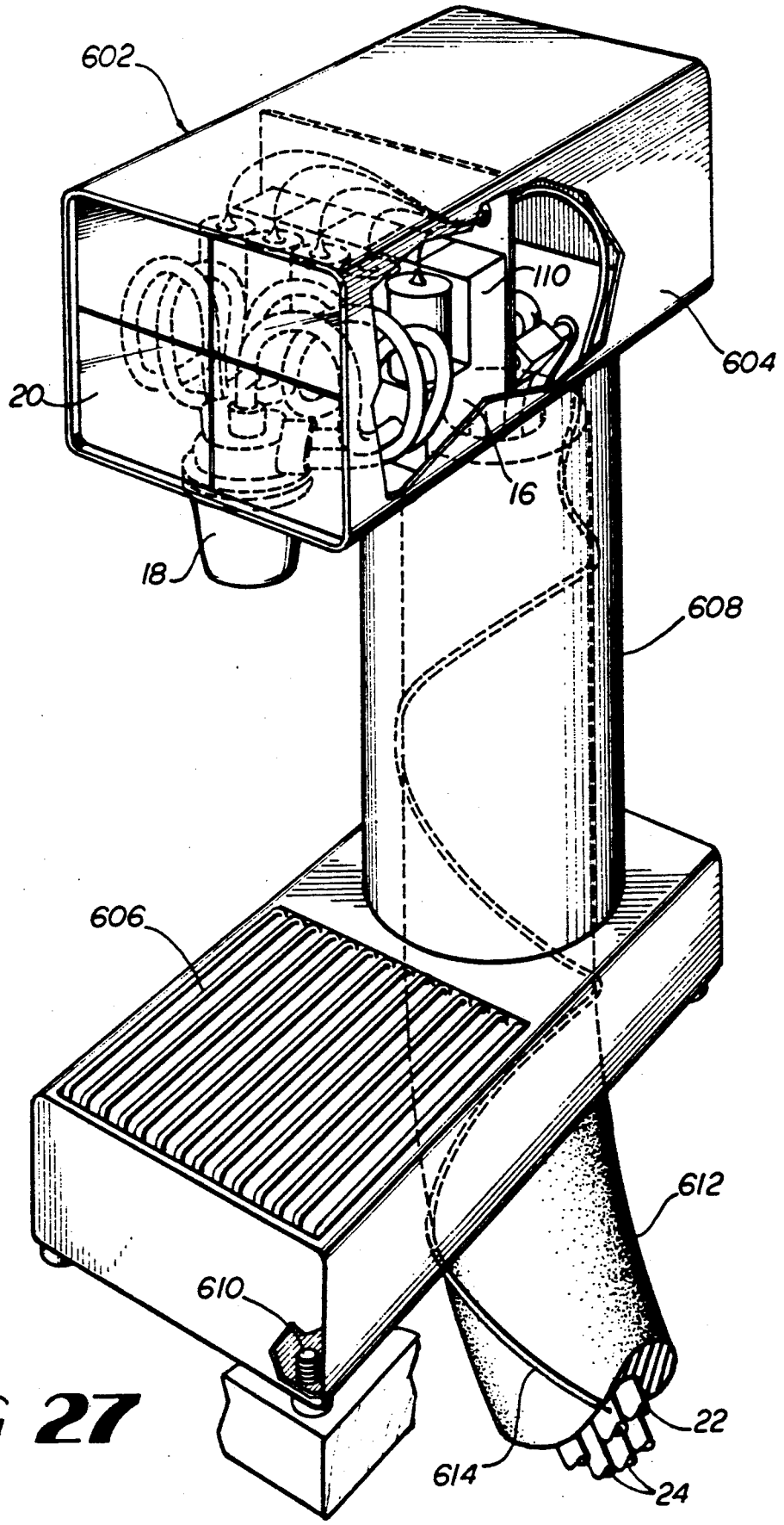
FIG. 27 is a partly broken away perspective view of the countertop unit of the dispenser of FIG. 26.

FIGS. 25 and 26 show another embodiment of a convertible dispenser 600 of the present invention. The dispenser 600 is similar to the dispensers described above and in particular to the arrangement shown in FIG. 3 in which the narrow dispenser module 14 is on top of the countertop 11 and the refrigeration module 12 (or 212) is beneath the countertop. In the dispenser 600, the same refrigeration module is used but a different dispense module 602 is used. The dispense module 602 is not part of (i.e., is not built-in) the complete dispenser 10 shown in the FIG. 1 arrangement, but includes some additional parts, and some of the parts of the dispenser 10 (or 210) are not used (and can be discarded).

This embodiment of the invention is used when the dispenser module 14 (or 214) is too large and it is desired to have a smaller countertop dispense module 602. However, the dispense module 602 is set up the same as is the dispense module 14 (or 214). The dispense module 602 includes a dispensing head 604, a drip tray assembly 606 and a support 608, which elements are not taken from and are not part of the original dispenser 10 (or 210). The dispense module 602 housing includes the head 604, the drip tray 606 and the support 608. The selector buttons 20 and the single multiflavor valve 16 are used and are located in the dispensing head 604. The syrup and water lines are bundled together in a python 612 and the electrical line 614, which is wrapped around the python, are all located inside of the support 608. The dispense module 602 is smaller than the dispense module 14. It is smaller mainly in its width, that is, its side-to-side dimension; it is preferably also shorter in height and smaller in its front-to-back dimension. The dispensing head 602 is closer to the valve 16, that is, there is less gap between the valve 16 and the dispensing head. Also, the individual flow control modules 110 can be rearranged, if desired, so as to take up less width.

The dispense module 602 is preferably secured to the countertop either by screws 610 or by a C-clamp (not shown), and includes means for receiving and mounting therein the selector buttons and the dispensing valves, these means being identical to those for the dispense module 14 (or 214).

Thus, when the dispense module 14 that is part of the dispenser 10 is larger than desired for a particular application, a customer would buy both the dispenser 10 and the additional second dispense module equipment of the dispensing head 604, drip tray 606 and support 608. The dispenser 600 would be set up similarly as in FIG. 3 except that the additional second dispense module 602 would be used in place of the existing dispense module 14.

To make the dispense module 602 even smaller (especially narrower), smaller buttons can be used rather than the buttons 20 from the dispenser and, also, the individual flow control modules can be rearranged in a narrower, more compact manner. The dispensing head 604 preferably has a removable bottom to which the top and side walls attach after the buttons and valve are mounted in place.

While the preferred embodiment of this invention has been described above in detail, it is to be understood that variations and modifications can be made therein without departing from the spirit and scope of the present invention. For example, while the preferred embodiment described above uses a multiflavor valve, this is not essential; it can alternatively use separate dispensing valves for each beverage or any combination of multiflavor and separate valves. In addition, while the preferred embodiment has been described for use with bag-in-box, it can also be used with figals, in which case the syrup pumps would not be included. The dispenser has been described for use with four separate syrups; this number can easily be changed by changing the number of flow control modules and syrup cooling coils. Other types and arrangements of the selector buttons can also be used. Instead of moving the buttons in switching between the FIGS. 1 and 2 arrangements, buttons can be located permanently in both places, with a cover over the ones not being used. As used herein, the term "convertible" means a dispenser that can be converted in size and shape to fit in different available spaces. In addition, when converting to the FIG. 3 mode, or preferably to the FIG. 11 mode, the hollow section 142 can be part of the dispense section with a hollow section like 72 left connected to the refrigeration module. Also, the long lines can be stored in the hollow section 72. This would make the conversion easier and could avoid the need for a conversion kit. The dispense module can be made as a one-piece unit, and when separated from the refrigeration module, an additional, separate panel could be added to the open side that faces the refrigeration module when connected thereto. The refrigeration system is preferably mechanical although a cold plate could be used.

What is claimed is:

1. A convertible multiflavor postmix beverage dispenser comprising:

(a) a refrigeration module and a separate dispense module, said refrigeration module having a refrigeration module housing and said dispense module having a dispense module housing;

(b) removable connecting means for connecting said housings together to operate as a one-piece unit and for separating said housings from each other to operate as a two-piece unit;

(c) means for connecting a water line in said refrigeration module to a water line in said dispense module;

(d) means for connecting a plurality of syrup lines in said refrigeration module to a plurality of syrup lines in said dispense module;

(e) said refrigeration module including a refrigeration unit and a carbonation unit inside of said refrigeration module housing;

(f) said dispense module including a plurality of selector buttons and a multiflavor dispensing valve with a dispensing nozzle for dispensing a beverage into a cup;

(g) said refrigeration module being larger than said dispense module and said refrigeration module housing having a width equal to the length of said dispense module housing and when said housings are connected together, one end of said refrigeration module housing being connected to one side of said dispense module housing;

(h) means on said one end of said refrigeration module housing for mounting a plurality of syrup pumps to the external surface thereof; and (i) said one side of said dispense module housing having a syrup pump opening therein and said dispense module housing including a hollow section adjacent said opening of a size sufficient to receive therein any syrup pumps mounted on said refrigeration module.

2. The apparatus as recited in claim 1 wherein said dispense module includes a dispense section and a separate hollow section, module when said housings are connected together, said rear walls having openings therein, means for connecting said sections together with said rear walls facing each other when said housings are separated, whereby said openings are hidden in said separated dispense module, and wherein each of said sections are identical squares in plan view.

3. The apparatus as recited in claim 1 wherein said refrigeration module housing and said dispense module housings have the same height.

4. The apparatus as recited in claim 1 wherein said dispense module includes a longer sidewall and a shorter frontwall, and including means for moving said selector buttons from said sidewall to said frontwall, and vice versa.

5. The apparatus as recited in claim 4 wherein said locating means includes an identical size opening in each of said frontwall and sidewall, and wherein said buttons are located in one of said openings and a removable panel is located in the other of said openings and including means for switching said panel and buttons.

6. The apparatus as recited in claim 1 wherein said refrigeration module includes a plurality of built-in syrup pumps connected thereto.

7. The apparatus as recited in claim 6 wherein said syrup pumps are mounted on said endwall of said refrigeration module housing and when said housings are connected together said pumps extend into said hollow section of said dispense module housing.

8. The apparatus as recited in claim 1 wherein said multiflavor valve includes a single mixing nozzle and a plurality of separate flow control modules, each flow control module including a solenoid controlled on-off valve and a flow control.

9. The apparatus as recited in claim 1 wherein said refrigeration housing includes a lid having a front portion and a rear portion, an air vent in each of said endwall, and front and rear portions, and means for covering said front portion air vent when said housings are separated, whereby when said housings are connected air can flow in said front portion air vent and out said rear portion air vent, and when said housings are separated said sections each having a rear wall facing said refrigeration air can flow in said endwall air vent and out said rear portion air vent.

10. The apparatus as recited in claim 1 wherein said refrigeration module includes a removable lid, an agitator motor and a separate condenser fan motor, wherein said condenser is oriented vertically, wherein said condenser fan and motor are a unitary modular unit easily removable straight up out of said refrigeration module when said lid has been removed, wherein said agitator motor is located below said fan motor and is easily accessible and removable when said fan and motor have been removed.

11. The apparatus as recited in claim 1 wherein said nozzle includes at least two syrup passageways therethrough for each syrup flavor and at least two, separate, spaced-apart, syrup outlet openings for each syrup flavor, to improve mixing.

12. The apparatus as recited in claim 1 wherein said water line includes a first portion extending into said carbonation unit and a second portion extending from said carbonation unit to said multiflavor valve, means for cooling said second portion, and means for recirculating the water solely in said second portion and not in said carbonation unit to cool it in said cooling means.

13. The apparatus as recited in claim 12 including pre-cooling means for cooling the water in said first portion of said water line.

14. The apparatus as recited in claim 12 wherein said recirculating means is a pump.

15. The apparatus as recited in claim 14 including means for operating said recirculating pump continuously when said housings are separated.

16. The apparatus as recited in claim 1 wherein said refrigeration module housing includes a one-piece metal shell which is continuous and uninterrupted on three sides thereof.

17. The apparatus as recited in claim 1 including a $CO_2$ source, a $CO_2$ line connected from said source to said carbonation unit and to said syrup pumps, wherein said refrigeration unit includes a plurality of syrup pumps, and a single pressure regulator controlling the same pressure to both said pumps and said carbonation unit.

18. A convertible, multiflavor postmix beverage dispenser comprising:

(a) a refrigeration module and a separate dispense module, said refrigeration module having a refrigeration module housing and said dispense module having a dispense module housing;

(b) removable connecting means for connecting said housings together to operate as a one-piece unit and for separating said housings from each other to operate as a two-piece unit;

(c) means for connecting a water line in said refrigeration module to a water line in said dispense module;

(d) means for connecting a plurality of syrup lines in said refrigeration module to a plurality of syrup lines in said dispense module;

(e) said refrigeration module including a refrigeration unit and a carbonation unit inside of said refrigeration module housing;

(f) said dispense module including a plurality of selector buttons and a multiflavor dispensing valve; and (g) when said housings are connected together said dispense module housing having a syrup pump opening in the sidewall thereof facing said refrigeration module and said dispense module housing having a hollow portion adjacent said opening of a size sufficient to accommodate therein a plurality of syrup pumps.

19. A convertible, multiflavor postmix beverage dispenser comprising:

(a) a refrigeration module and a separate dispense module, said refrigeration module having a refrigeration module housing and said dispense module having a dispense module housing;

(b) removable connecting means for connecting said housings together to operate as a one-piece unit and for operating said housings from each other to operate as a two-piece unit;

(c) means for connecting a water line in said refrigeration module to a water line in said dispense module;

(d) means for connecting a plurality of syrup lines in said refrigeration module to a plurality of syrup lines in said dispense module;

(e) said refrigeration module including a refrigeration unit and a carbonation unit inside of said refrigeration module housing;

(f) said dispense module including a plurality of selector buttons and a multiflavor dispensing valve; and (g) said dispense module including a hollow section and a separate dispense section, each separately connected to said refrigeration module, means for disconnecting said sections from said refrigeration module, and means for connecting said sections together to form a free-standing dispense module.

20. The apparatus as recited in claim 19 wherein each of aid sections is an identical square in plan view.

21. The apparatus as recited in claim 19 wherein the sidewall of each section that is connected to said refrigeration module has an opening and including means for connecting said sidewalls together when said housings are separated.

22. A convertible postmix beverage dispenser comprising:

(a) a refrigeration module and a separate dispenser module, said refrigeration module having a refrigeration module housing and said dispense module having a dispense module housing;

(b) removable connecting means for connecting said housings together to operate as a one-piece unit and for separating said housings from each other to operate as a two-piece unit;

(c) means for connecting a water line in said refrigeration module to a water line in said dispense module;

(d) means for connecting a syrup line in said refrigeration module to a water line in said dispense module;

(d) means for connecting a syrup line in said refrigeration module to a syrup line in said dispense module;

(e) said refrigeration module including a refrigeration unit;

(f) said dispense module including a dispensing valve and a dispensing nozzle for dispensing a beverage therefrom; and (g) said refrigeration module being larger than said dispense module and said refrigeration module housing having a width equal to the length of said dispense module housing and when said housings are connected together, one end of said refrigeration module housing being connected to one side of said dispense module housing.

23. The apparatus as recited in claim 22 including means on said one end of said refrigeration module housing for mounting a plurality of syrup pumps to the external surface thereof, and said one side of said dispense module housing having a syrup pump opening therein and said dispense module including a hollow section adjacent said opening of a size sufficient to receive therein any syrup pumps mounted on said external surface of said refrigeration module.

24. The apparatus as recited in claim 23 wherein said syrup line connecting means includes a plurality of syrup lines, and wherein said dispense module includes a plurality of selector buttons.

25. The apparatus as recited in claim 23 wherein said syrup line connecting means includes a plurality of syrup lines, and wherein said dispensing valve is a multiflavor valve.

26. The apparatus as recited in claim 23 wherein said multiflavor valve includes a single mixing nozzle and a plurality of separate flow control modules, each flow control module including a solenoid controlled on-off valve and a flow control.

27. The apparatus as recited in claim 23 wherein said housings are removably connected together and said water line and syrup line connecting means are mating fittings on the respective water and syrup lines in the refrigeration and dispense modules.

28. The apparatus as recited in claim 23 wherein said refrigeration module includes a built-in syrup pump and a built-in carbonation unit.

29. The apparatus as recited in claim 28 including a plurality of said built-in syrup pumps.

30. The apparatus as recited in claim 23 wherein said housings are separated and wherein said water line connecting means and said syrup line connecting means are long, flexible lines such that said refrigeration module can be placed below a counter and said dispense module can be placed above said counter.

31. The apparatus as recited in claim 23 including means for changing the number of selector buttons and syrup lines.

32. The apparatus as recited in claim 23 wherein said dispense module includes a longer sidewall and a shorter frontwall, and including means for locating said selector button on either said sidewall or said frontwall.

33. The apparatus as recited in claim 32 including a plurality of said selector buttons.

34. The apparatus as recited in claim 22 wherein said refrigeration module includes a carbonation unit.

35. The apparatus as recited in claim 22 wherein said dispense module includes manual means for activating said dispensing valve to dispense a beverage.

36. The apparatus as recited in claim 35 wherein said manual means includes a selector button.

37. A convertible postmix beverage dispenser comprising:

(a) a refrigeration module and a separate dispense module, said refrigeration module having a refrigeration module housing and said dispense module having a dispense module housing;

(b) removable connecting means for connecting said housings together to operate as a one-piece unit and for operating said housings from each other to operate as a two-piece unit;

(c) means for connecting a water line in said refrigeration module to a water line in said dispense module;

(d) means for connecting a syrup line in said refrigeration module to a syrup line in said dispense module;

(e) said refrigeration module including a refrigeration unit and a carbonation unit;

(f) said dispense module including a selector button and a dispensing valve; and (g) wherein said dispense module includes a dispense section and a hollow section, said sections each having a rear wall facing said refrigeration module when said housings are connected together, said rear walls having openings therein and means for connecting said sections together with said rear walls facing each other when said housings are separated, whereby said openings are hidden in said separated dispense module.

38. A method for dispensing beverages comprising:

(a) providing a convertible beverage dispenser including a refrigeration module and a separate, built-in dispense module, said refrigeration module having a refrigeration module housing and said dispense module having a dispense module housing, (b) connecting a water line in said refrigeration module to a water line in said dispense module;

(c) connecting a syrup line in said refrigeration module to a syrup line in said dispense module;

(d) providing a selector button and a dispensing valve in said dispense module;

(e) connecting said housings together when it is desired to operate said convertible dispenser as a one-piece countertop unit;

(f) separating said housings from each other when it is desired to operate said dispenser as a two-piece unit and placing said refrigeration module below a countertop;

(g) removing said selector button and dispensing valve from said dispense module and installing said button and valve in a second dispense module narrower than said built-in dispense module;

(h) securing said second dispense module to said countertop; and (i) connecting said water line and said syrup line to said dispensing valve.

39. A convertible multiflavor postmix beverage dispenser comprising:

(a) a refrigeration module and a separate, built-in dispense module, said refrigeration module having a refrigeration module housing and said dispense module having a dispense module housing;

(b) removable connecting means for connecting said housings together to operate as a one-piece unit and for separating said housings from each other such that said refrigeration module can be placed below a countertop for use with a countertop dispense module;

(c) means for connecting a water line in said refrigeration module to a water line in said dispense module;

(d) means for connecting a plurality of syrup lines in said refrigeration module to a plurality of syrup lines in said dispense module;

(e) said refrigeration module including a refrigeration unit and a carbonation unit inside of said refrigeration module housing;

(f) said dispense module including a plurality of selector buttons and a multiflavor dispensing valve with a dispensing nozzle for dispensing a beverage into a cup;

(g) said refrigeration module being larger than said dispense module and said refrigeration module housing having a width equal to the length of said dispense module housing and when said housings are connected together one end of said refrigeration module housing being connected to one side of said dispense module housing;

(h) means on said one end of said refrigeration module housing for mounting a plurality of syrup pumps to the external surface thereof;

(i) said one side of said dispense module housing having a syrup pump opening therein and said dispense module housing including a hollow section adjacent said opening of a size sufficient to receive therein any syrup pumps mounted on said refrigeration module; and (j) a second dispense module narrower than said built-in dispense module, means for securing said second dispense module to a countertop and means for receiving and mounting therein said selector buttons and said dispensing valve.

40. A method for dispensing beverages comprising:

(a) providing a convertible beverage dispenser including a refrigeration module and a separate dispense module, said refrigeration module having a refrigeration module housing and said dispense module having a dispense module housing;

(b) connecting a water line in said refrigeration module to a water line in said dispense module;

(c) connecting a syrup line in said refrigeration module to a syrup line in said dispense module;

(d) providing a selector button and a dispensing valve in said dispense module;

(e) connecting said housings together when it is desired to operate said convertible dispenser as a one-piece countertop unit;

(f) said housings from each other when it is desired to operate said dispenser as a two-piece unit, placing said refrigeration module below said countertop and placing only said dispense module on top of said countertop; and (g) wherein said dispense module includes a dispense section and a separate hollow section, said sections each having a rear wall facing said refrigeration module when said housings are connected together and said rear walls having openings therein, and including the step of connecting said sections together with their rear walls facing each other when said housings are separated, whereby said openings are hidden.

41. A method for dispensing beverages comprising:

(a) providing a convertible beverage dispenser including a refrigeration module and a separate dispense module, said refrigeration module having a refrigeration module housing and said dispense module having a dispense module housing, (b) connecting a water line in said refrigeration module to a water line in said dispense module;

(c) connecting a syrup line in said refrigeration module to a syrup line in said dispense module;

(d) providing a selector button and a dispensing valve in said dispense module;

(e) connecting said housings together when it is desired to operate said convertible dispenser as a one-piece countertop unit; and (f) disconnecting said housings from each other when it is desired to operate said dispenser as a two-piece unit, placing said refrigeration module below said countertop and placing only said dispense module on top of said countertop.

42. The method as recited in claim 41 wherein said dispense has a notched corner dispensing station and wherein has a longer front wall and a narrower sidewall, and wherein said housings are connected together and said selector buttons are on said frontwall adjacent said notched corner dispensing station, and including the step of moving said dispenser to face sideways on said countertop and moving said selector buttons from said frontwall to said sidewall.

43. The method as recited in claim 41 wherein said dispensing valve is a multiflavor valve including a single mixing nozzle and a plurality of separate flow control modules, each flow control module including a solenoid controlled on-off valve and a flow control, and including the step of changing the number of beverages to be dispensed by changing the number of said flow control modules in said flow control modules in said dispense module.

* * * * *

UNITED STATES PATENT AND TRADEMARK OFFICE

CERTIFICATE OF CORRECTION

PATENT NO. : 5,190,188

DATED : March 2, 1993

INVENTOR(S) : William S. Credle, Jr.

It is certified that error appears in the above-identified patent and that said Letters Patent is hereby corrected as shown below:

Col. 12, line 35, delete "operating" and insert --separating-- therefor.

Col. 12, line 55, delete "aid" and insert --said--therefor.

Col. 14, line 18, delete "operating" and insert --separating-- therefor.

Col. 16, line 4, insert --separating-- after "(f)".

Col. 16, line 41, insert --module-- after "dispense";

Col. 16, line 40, insert --said dispenser-- after "wherein";

Col. 16, line 43, insert --of said-- after "corner".

Signed and Sealed this

Twelfth Day of April, 1994

Bruce Lehman

*Attest:*

BRUCE LEHMAN

*Commissioner of Patents and Trademarks*

*Attesting Officer*